US009336712B2

(12) United States Patent
Mizukoshi et al.

(10) Patent No.: US 9,336,712 B2
(45) Date of Patent: May 10, 2016

(54) DISPLAY DEVICE

(75) Inventors: Seiichi Mizukoshi, Chigasaki (JP); Nobuyki Mori, Asaka (JP); Kazuyoshi Kawabe, Kanagawa (JP); Makoto Kohno, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 528 days.

(21) Appl. No.: 13/379,581

(22) PCT Filed: Jul. 1, 2010

(86) PCT No.: PCT/US2010/040762

§ 371 (c)(1),
(2), (4) Date: Mar. 9, 2012

(87) PCT Pub. No.: WO2011/005651

PCT Pub. Date: Jan. 13, 2011

(65) Prior Publication Data

US 2012/0287171 A1 Nov. 15, 2012

(30) Foreign Application Priority Data

Jul. 7, 2009 (JP) ..... 2009-160625

(51) Int. Cl.
*G09G 5/10* (2006.01)
*G09G 3/32* (2016.01)

(52) U.S. Cl.
CPC ..... *G09G 3/3233* (2013.01); *G09G 2300/0866* (2013.01); *G09G 2310/0256* (2013.01); *G09G 2320/043* (2013.01); *G09G 2330/021* (2013.01)

(58) Field of Classification Search
CPC . G09G 3/3233; G09G 3/3688; G09G 3/2648; G09G 2330/021; G09G 2330/043; G09G 2320/043; G09G 2320/0276; G09G 2360/16
USPC ..... 345/77, 204, 214, 690; 257/59, 72, 257/E29.273
See application file for complete search history.

(56) References Cited

U.S. PATENT DOCUMENTS

| | | | | |
|---|---|---|---|---|
| 5,748,165 | A | 5/1998 | Kubota | |
| 2004/0079945 | A1 * | 4/2004 | Weaver et al. | 257/71 |
| 2004/0090186 | A1 * | 5/2004 | Yoshida et al. | 315/169.1 |
| 2006/0007072 | A1 | 1/2006 | Choi et al. | |
| 2006/0187154 | A1 | 8/2006 | Tsuchida | |

(Continued)

FOREIGN PATENT DOCUMENTS

| | | |
|---|---|---|
| JP | 2006-251455 A | 9/2006 |
| JP | 2006-330323 | 12/2006 |

(Continued)

*Primary Examiner* — Michael Pervan
*Assistant Examiner* — Andrew Lee
(74) *Attorney, Agent, or Firm* — Global OLED Technology LLC

(57) ABSTRACT

To alleviate an afterimage phenomenon caused by a hysteresis characteristic of a drive transistor. Current driven type light emitting elements 3 are provided for each of pixels 6 that are arranged in a matrix shape, and current of the light emitting elements 3 is controlled using drive TFTs 2 that operate by receiving data voltage on a gate. At least two power supply voltages (PVDDa, PVDDb) for supply to each pixel are provided, one being set to a voltage such that current corresponding to a data voltage flows in the drive TFT 2, the other being set to a voltage beyond a variation range of data voltage and that reverse biases the drive TFT 2, and the two power supply voltages are switched and supplied to each pixel 6.

3 Claims, 28 Drawing Sheets

(56) References Cited

U.S. PATENT DOCUMENTS

| | | | | |
|---|---|---|---|---|
| 2006/0267886 | A1 | 11/2006 | Ozaki | |
| 2006/0273999 | A1* | 12/2006 | Yamazaki et al. | 345/81 |
| 2007/0063993 | A1 | 3/2007 | Shishido | |
| 2008/0284679 | A1 | 11/2008 | Ishizuka | |
| 2009/0179838 | A1* | 7/2009 | Yamashita et al. | 345/84 |
| 2010/0026732 | A1* | 2/2010 | Otawara | 345/690 |

FOREIGN PATENT DOCUMENTS

| | | |
|---|---|---|
| JP | 2006330323 | 12/2006 |
| WO | 2006/121138 | 11/2006 |
| WO | 2006121138 | 11/2006 |

* cited by examiner

DISPLAY DEVICE

This application is a National Stage Entry of International Application No. PCT/US2010/040762, filed Jul. 1, 2010, and claims the benefit of Japanese Application No. 2009-160625, filed on Jul. 7, 2009, which is hereby incorporated by reference for all purposes as if fully set forth herein.

BACKGROUND OF THE INVENTION

1. Field of the Invention

The present invention relates to an active matrix type display device, having current driven light emitting elements provided for every one of pixels that are arranged in a matrix shape, for performing display by controlling current of the light emitting elements using drive TFTs that operate by receiving a data voltage at a gate.

2. Description of the Related Art

FIG. 1 shows the structure of a circuit for one pixel section (pixel circuit) of a basic active organic EL display device. An image data signal is stored in a storage capacitor C arranged across gate and source of a drive TFT 2 by setting a gate line (Gate), that extends in the horizontal direction, to a high level to turn a selection TFT 1 on, and in this state supplying an image data signal (also called data voltage) having a voltage corresponding to a display brightness, to a data line (Data) that extends in the vertical direction. In this manner, a drive TFT (a P-type TFT in this example) 2 having its source connected to PVdd supplies a drive current corresponding to the data signal to an organic EL element 3 that is connected to the drain of that TFT. As a result, the organic EL element 3 emits light in accordance with the data signal.

FIG. 2 shows one example of the structure of a display panel, and input signals. In FIG. 2, an image data signal, a horizontal sync signal (HD), a pixel clock and other drive signals are supplied to a source driver. Pixel data signals are sent to the source driver in synchronism with the pixel clock, held in an internal latch circuit once image data signals for a single horizontal line of pixels have been acquired, and subjected to D/A conversion simultaneously for supply to a data line (Data) of a corresponding row. Also, the horizontal sync signal (HD), other drive signals and a vertical sync signal (VD) are supplied to a gate driver 5. The gate driver 5 performs control to sequentially turn on gate lines (Gate) arranged horizontally along each line, so that image data signals are supplied to pixels of the corresponding lines. The pixel circuit of FIG. 1 is provided in each of the pixels 6 that are arranged in a matrix shape.

As a result of this type of structure, image data signals (data voltages) are sequentially written to each pixel in horizontal line units, and display is carried out at each pixel in accordance with the written image data signals, to perform image display as a panel.

Here the amount of light emission and current of the organic EL element 3 are in a substantially proportional relationship. Normally, a voltage (Vth) is supplied across the gate of the drive TFT 2 and PVdd such that a drain current approaching that for a black level of the pixel starts to flow. Also, the amplitude of the image signal is an amplitude so as to give a prescribed brightness close to a white level.

FIG. 3 shows a relationship for current "CV current" (corresponding to brightness) flowing in the organic EL element with respect to input signal voltage (voltage of the data line Data) of the drive TFT. It is possible to carry out appropriate gradation control for the organic EL element by determining the data signal so that Vb is supplied as the black level voltage and Vw is supplied as the white level voltage.

PRIOR ART REFERENCES

Patent Publications

Patent document 1: Japanese Unexamined Patent No. 2006-251455

With an active matrix type organic EL display device, there is a problem in that an after image arises on part of the display panel, due to a hysteresis characteristic of drive TFTs. In particular, this is particularly noticeable when a white window or the like remains on a grey background, and a completely grey image is changed to. In this case, portions where the white window was displayed immediately before are slightly darker than other portions, and it takes between a few seconds to a few tens of seconds until they become the same brightness as the other portions. This can be considered to be due to a phenomenon where even if a drive TFT for a particular pixel is driven with the same data voltage there is a difference in the drive current due to current that was flowing for a few seconds previously, such that carriers (positive holes) flowing in the drive TFT are trapped in a gate insulation layer, and Vth of the drive TFT is varied.

There has therefore been a need to alleviate the afterimage phenomenon caused by the hysteresis characteristic of the drive TFTs, without increasing the number of transistors in the pixel circuit.

It is also known that by applying a reverse bias voltage across the gate and source of the drive TFT, namely a voltage that is higher than PVdd connected to the source, to the gate, carriers (positive holes) in the gate insulation layer of the gate are removed. Also, this effect increases with increase in reverse bias voltage and with increase in length of time of application.

SUMMARY OF THE INVENTION

The present invention provides an active matrix type display device, having current driven light emitting elements provided for each of pixels arranged in a matrix shape, for performing display by controlling current of the light emitting elements using TFTs that operate by receiving a data voltage at a gate, wherein at least two power supply voltages to be supplied to each pixel are provided, one set to a voltage at which current corresponding to a data voltage flows in the drive TFTs, the other set to a voltage that applies a reverse bias to the drive TFTs, being a voltage that is in excess of a range of variation of the data voltage, with two power supply voltages being switched for supply to each pixel.

The present invention also provides an active matrix type display device, having current driven light emitting elements provided for each of pixels arranged in a matrix shape, for performing display by controlling current of the light emitting elements using P-channel TFTs that operate by receiving a data voltage at a gate, having horizontal power supply lines, arranged in a horizontal direction, connected to sources of drive TFTs of corresponding horizontal lines, with these horizontal power supply lines being divided into groups made up of one or a plurality of horizontal power supply lines, and switches for alternatively connecting these groups of horizontal power supply lines to at least two power supply voltages, wherein one power supply voltage is a voltage for supplying a current corresponding to a data voltage to a source of a drive TFT, and the other power supply voltage being a voltage that is lower that the minimum value of data voltage.

The present invention also provides an active matrix type display device, having current driven light emitting elements provided for each of pixels arranged in a matrix shape, for performing display by controlling current of the light emitting elements using N-channel TFTs that operate by receiving a data voltage at a gate, having horizontal power supply lines, arranged in a horizontal direction, connected to sources of drive TFTs of corresponding horizontal lines, with these horizontal power supply lines being divided into groups made up of one or a plurality of horizontal power supply lines, and switches for alternatively connecting these groups of horizontal power supply lines to at least two power supply voltages, wherein one power supply voltage is a voltage for supplying a current corresponding to a data voltage to a source of a drive TFT, and the other power supply voltage being a voltage that is higher that the maximum value of data voltage.

It is also preferable for each pixel to include a storage capacitor connected across a gate and source of the drive TFT, a selection TFT for supplying a data voltage to the storage capacitor, and to have gate lines, arranged in a horizontal direction, for turning selection TFTs of each pixel in the horizontal direction on or off.

It is also preferable for one of the power supplies to be a power supply voltage such that the operation of the drive TFT is in the non-saturation region, and to write image data by turning a selection TFT on while selecting this power supply.

It is also preferable for the timing of turning on a selection TFT while selecting the other power supply voltage to be a fixed period before the timing of writing the data voltage to each pixel.

In this way, according to the present invention a period in which reverse bias is applied to the drive TFT is provided. It is therefore possible to alleviate the afterimage phenomenon due to hysteresis characteristics of the drive TFTs.

DESCRIPTION OF THE PREFERRED EMBODIMENTS

Embodiments of the present invention will be described in the following based on the drawings.

Figure 2:
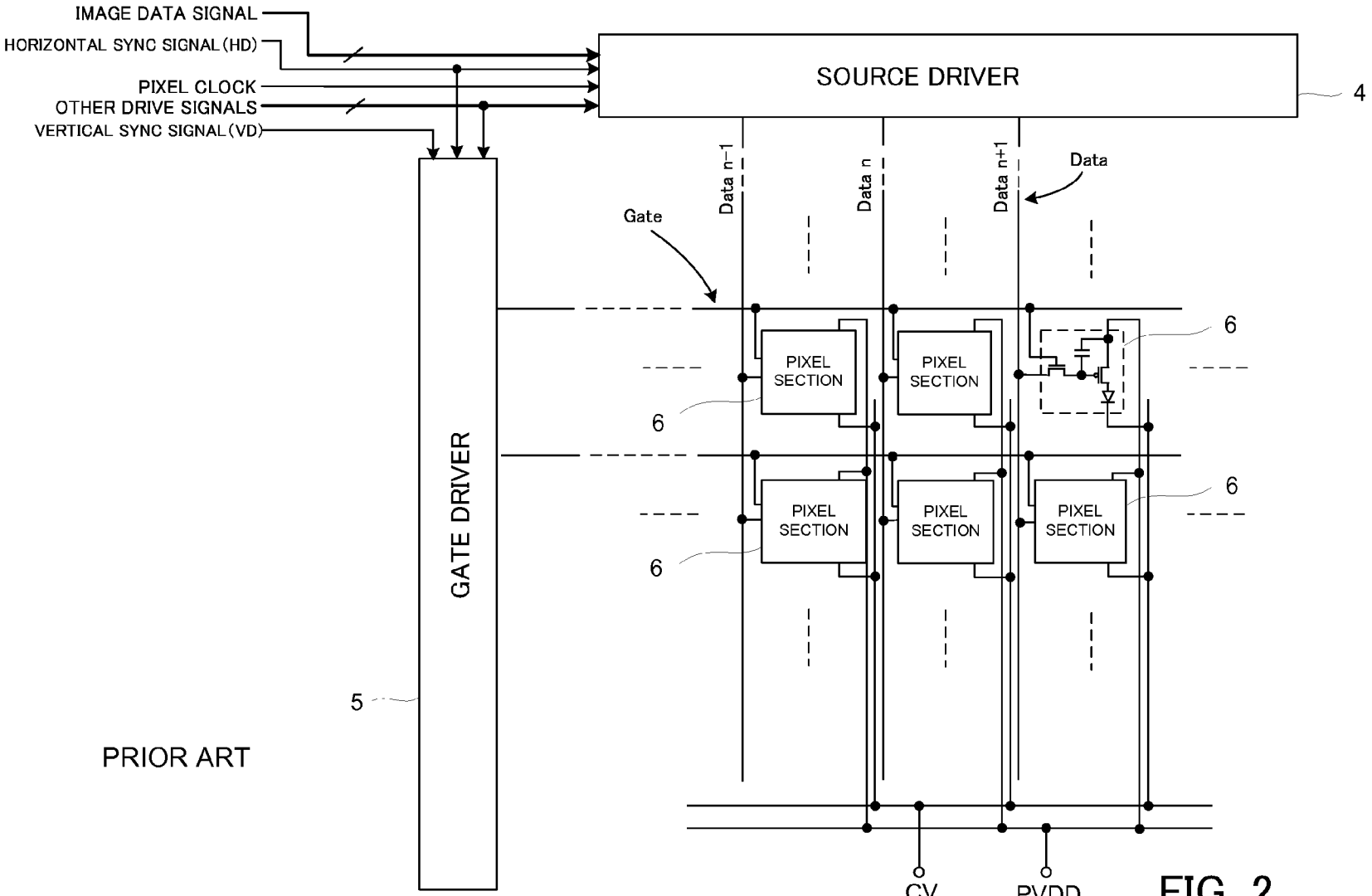
FIG. 2 PRIOR ART
FIG. 2 is a drawing showing one example of the structure of a display panel, and input signals.
Figure 3:
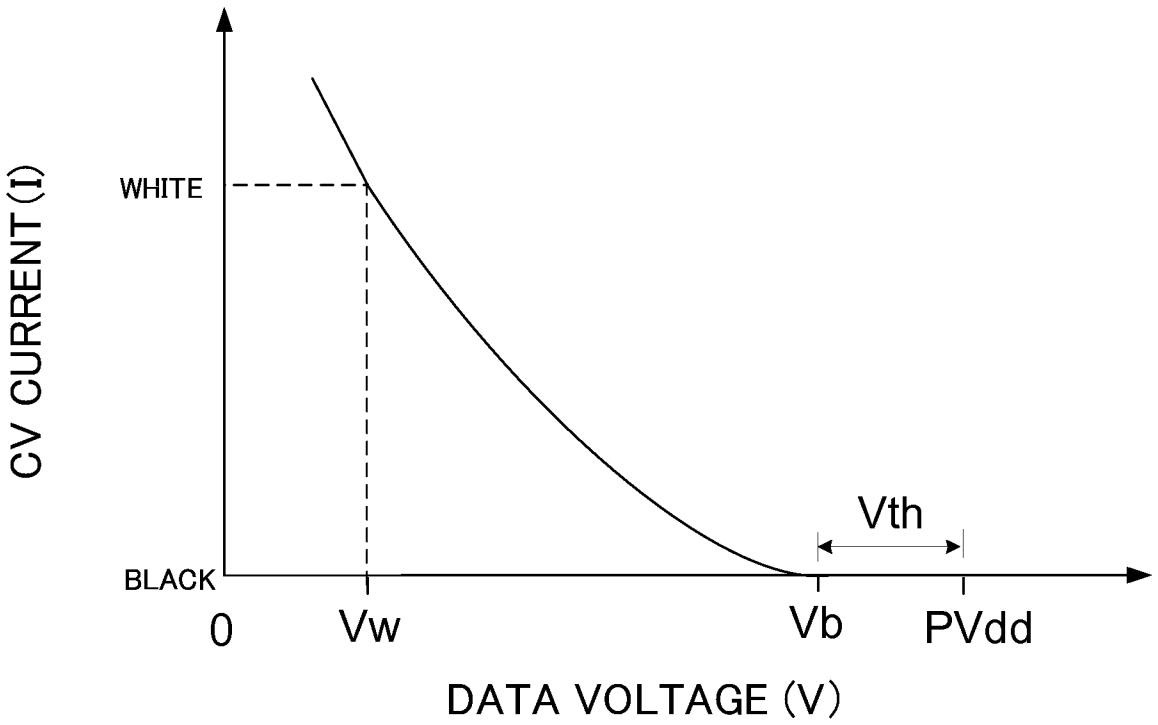
FIG. 3 PRIOR ART
FIG. 3 is a drawing showing a relationship between CV current flowing in an organic EL element with respect to input signal voltage of the drive TFT.
Figure 4:
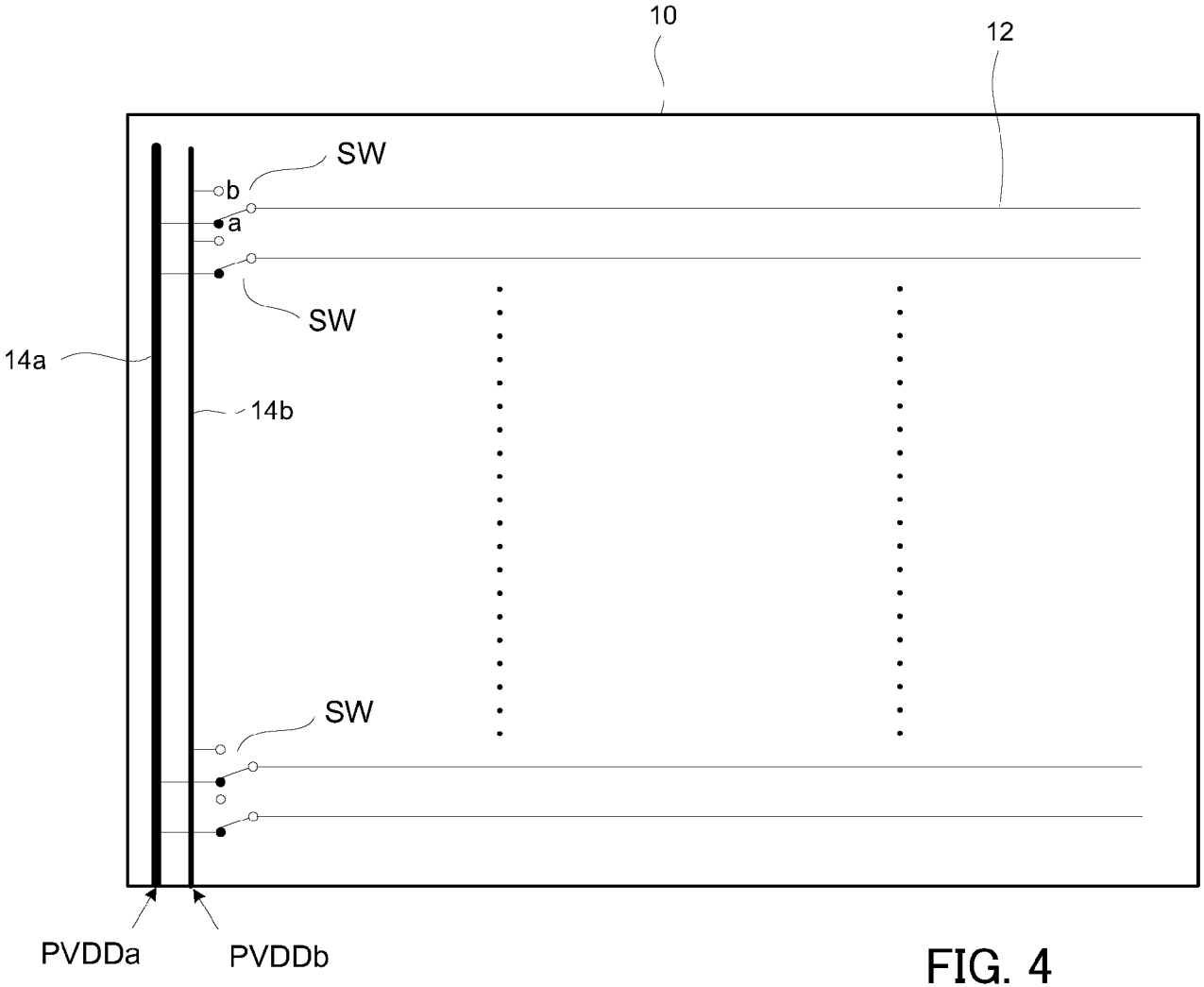
FIG. 4 is a drawing showing one example of layout of power supply lines (horizontal and vertical PVDD) in the case where a switch is provided at one side of every horizontal PVDD line.

FIG. 4 shows one example of layout of power supply lines (horizontal and vertical PVDD lines) in the case where a switch is provided at one side of every horizontal PVDD line. In the organic EL panel 10, pixels are arranged in a matrix shape, as shown in FIG. 2. Horizontal PVDD lines 12 are arranged one for each line of pixels. A vertical PVDD line 14*a* connected to power supply PVDDa, and a vertical PVDD line 14*b* connected to power supply PVDDb are arranged at one side of the organic EL panel 10, and each horizontal PVDD line 12 is switchably connected to either of the two vertical PVDD lines 14*a* and 14*b*.

Figure 5:
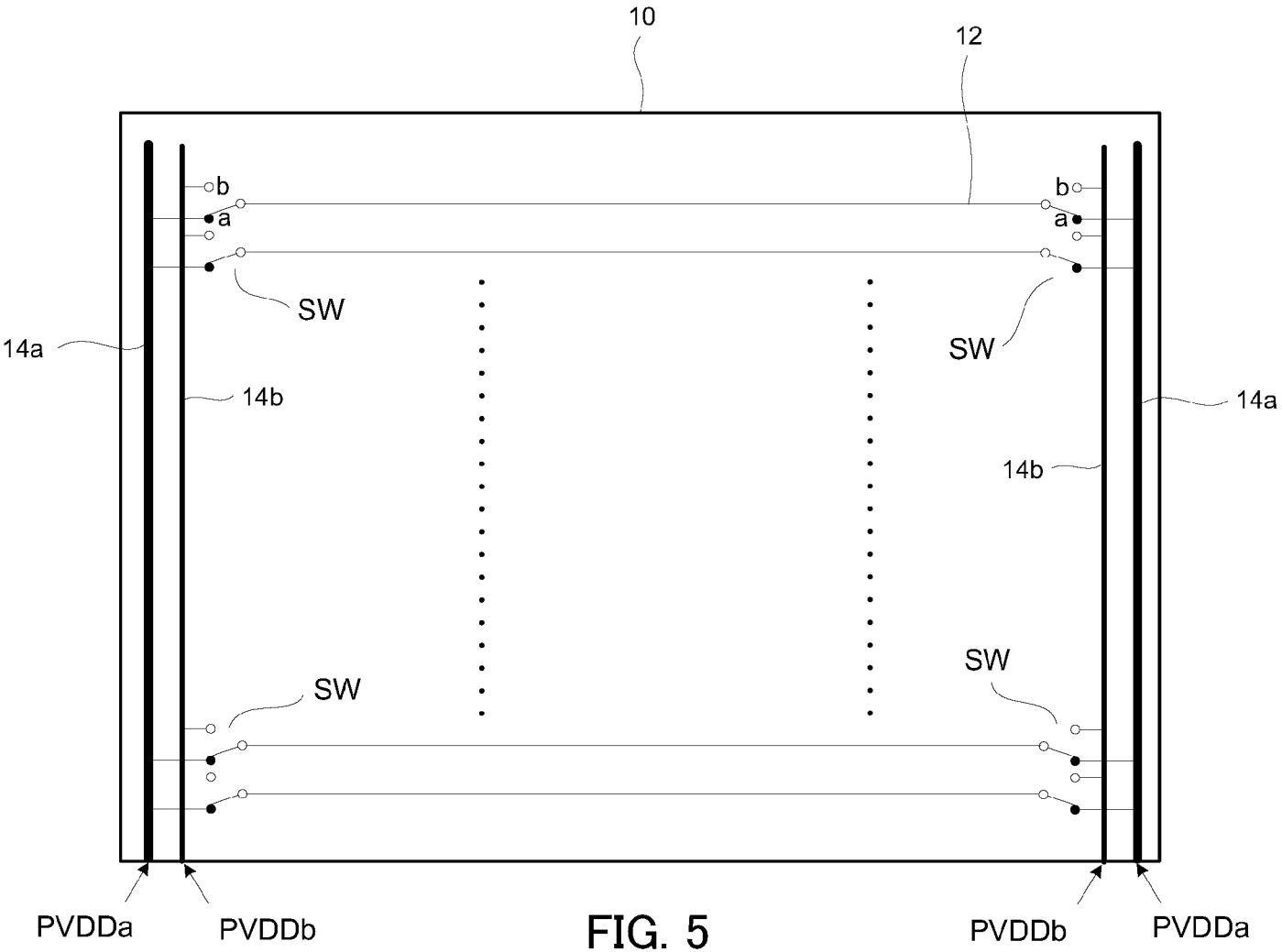
FIG. 5 is a drawing showing an example of layout of power supply lines in the case where switches are provided at both sides.

FIG. 5 shows an example of layout of power supply lines in the case where switches are provided at both sides. The vertical PVDD lines 14*a* and 14*b* are respectively provided on both sides of the organic EL panel 10, and each horizontal PVDD line 12 is switchably connected at both ends to either one of the vertical PVDD lines 14*a* or 14*b* via switches SW. The switches provided at both sides of a single horizontal PVDD line 12 are controlled so as to be connected to the same vertical PVDD line 14*a* or 14*b*.

Here PVDDa is a power supply connected at the time of pixel light emission, and PVDDb is a power supply connected at the time of applying a reverse bias voltage. A comparatively large current flows in the vertical PVDD lines 14*a*, and so voltage lowering due to a resistive component can be alleviated by making the track width thicker etc. On the other hand almost no current flows in the vertical PVDD lines 14*b*, so track width can be made narrow. By providing the switches on both sides as shown in FIG. 5, connection is established between the vertical PVDD lines 14*a* and the power supply, and it is possible to reduce voltage lowering due to wiring resistance from the PVDDa terminal to the pixel.

Figure 6:
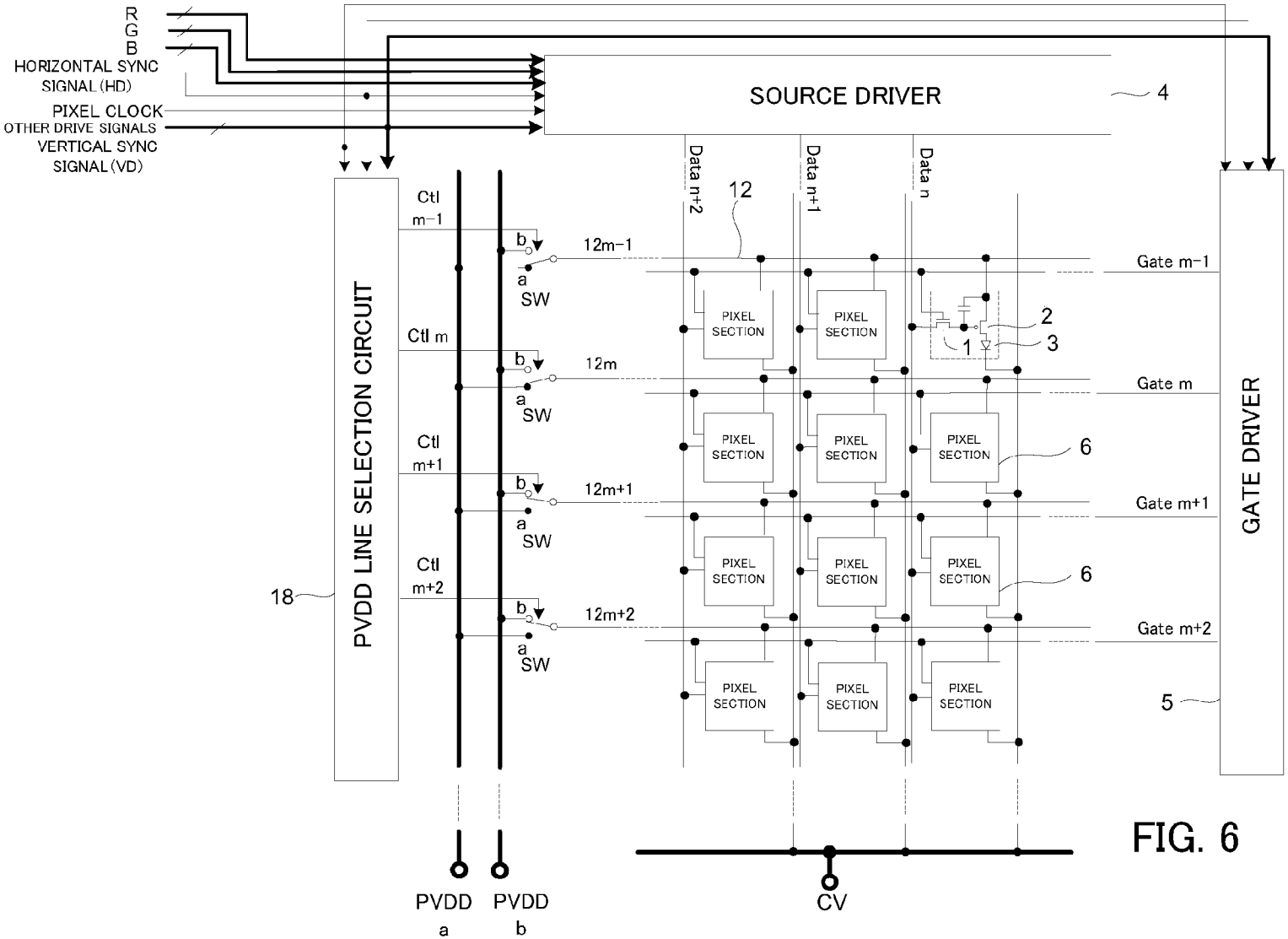
FIG. 6 is a drawing showing a structural example of a panel in the case where a switch SW is provided on one side of every horizontal PVDD line.

FIG. 6 corresponds to FIG. 4, and is a structural example of a panel in the case where switches are provided on one side of every horizontal PVDD line 12, showing 4 lines by 3 rows of pixels 6 (lines m−1 to m+2, and rows n to n+2). In this way a PVDD line selection circuit 18 is provided, and switching of the switches SW is controlled by this PVDD line selection circuit 18. Lines for controlling switches SW from the horizontal PVDD line selection circuit 18 are made lines Ctlm−1 to Ctlm+2.

Figure 7:
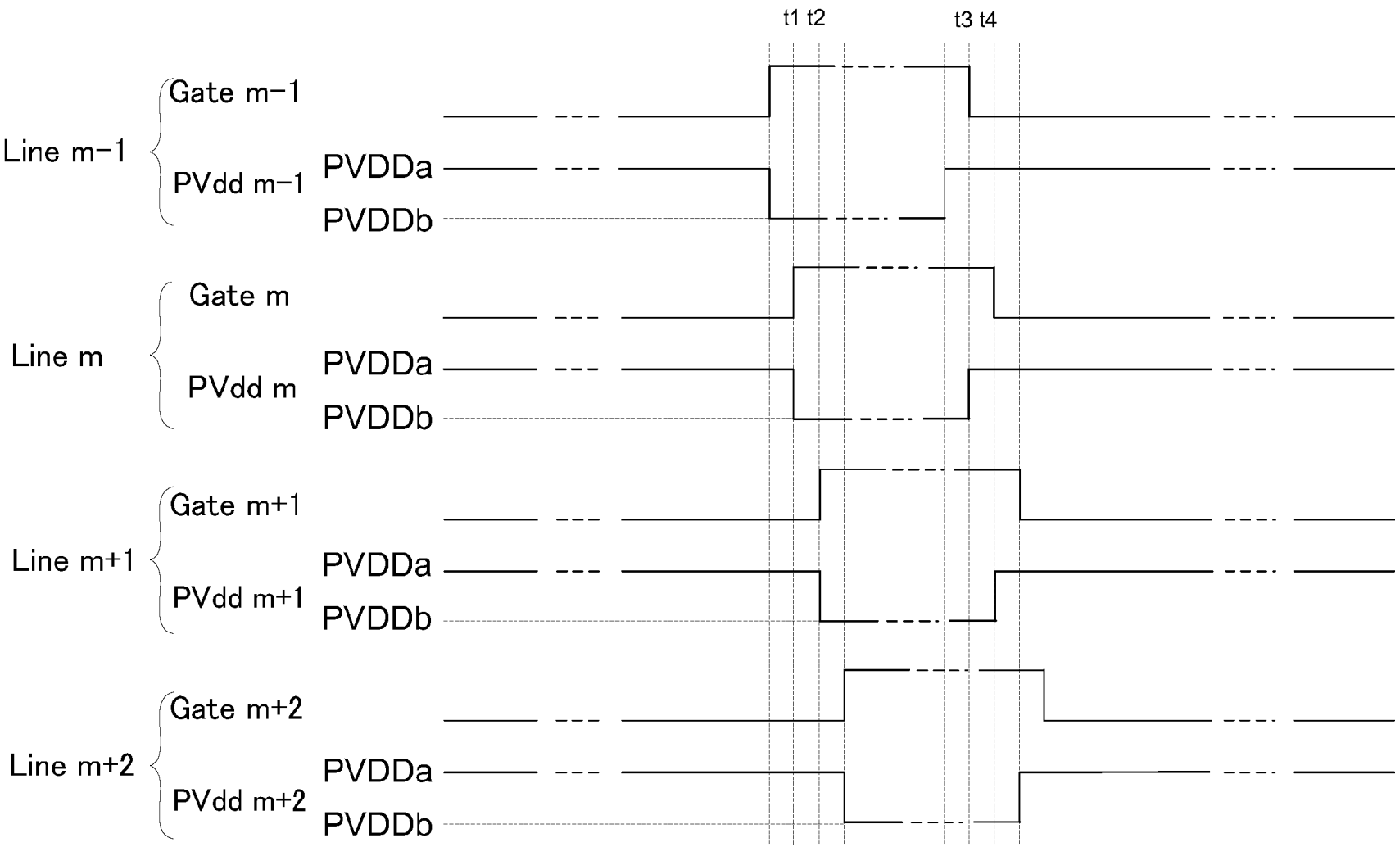
FIG. 7 us a drawing showing timing for changing voltage of horizontal PVDD lines and gate lines.

FIG. 7 shows timing for changing voltage of horizontal PVDD lines 12 and gate lines Gate. At the time of light emission and data write, the switches SW are turned to the a side so that power is supplied from the vertical PVDD lines 14*a* (PVDDa) to the horizontal PVDD line 12 of those lines. On the other hand, taking line m as an example, in the period tl to t3, the switches SW are similarly controlled to supply power from the vertical PVDD lines 14*b* (PVDDb). At this time, a gate line is set to a high level to tum on the selection TFT. In this way, a data voltage for writing a particular horizontal pixel is applied to the drive TFT, but by setting PVDDb to the minimum write voltage, that is, lower than the minimum output voltage of the source driver 4, a reverse bias is always applied to the drive TFT and the pixel is turned off. Writing of the data voltage is carried out when, in the period from t3 to t4, the Gatem is at high level and the voltage of PVDDm is PVDDa, and light emission continues in the next frame after t4 until Gatem becomes high level again.

Figure 8:
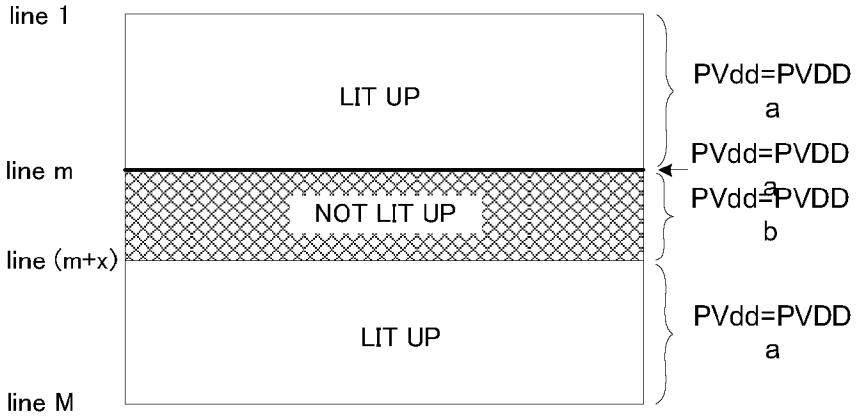
FIG. 8 is a drawing showing a lit up state of a screen in a period t3-t4.

FIG. 8 shows a lit up state of a screen in a period t3-t4. The longer the period from t3 to t4, the larger the effect of the characteristic of the TFT returning to normal, but since the period the pixel is turned off then becomes longer, the average brightness is lowered and it is becomes easier to notice pixel flicker. Accordingly, it is necessary for the time that the reverse bias is applied to be optimized according to TFT characteristic, as well as use and specifications of the display device etc.

Figure 9A:
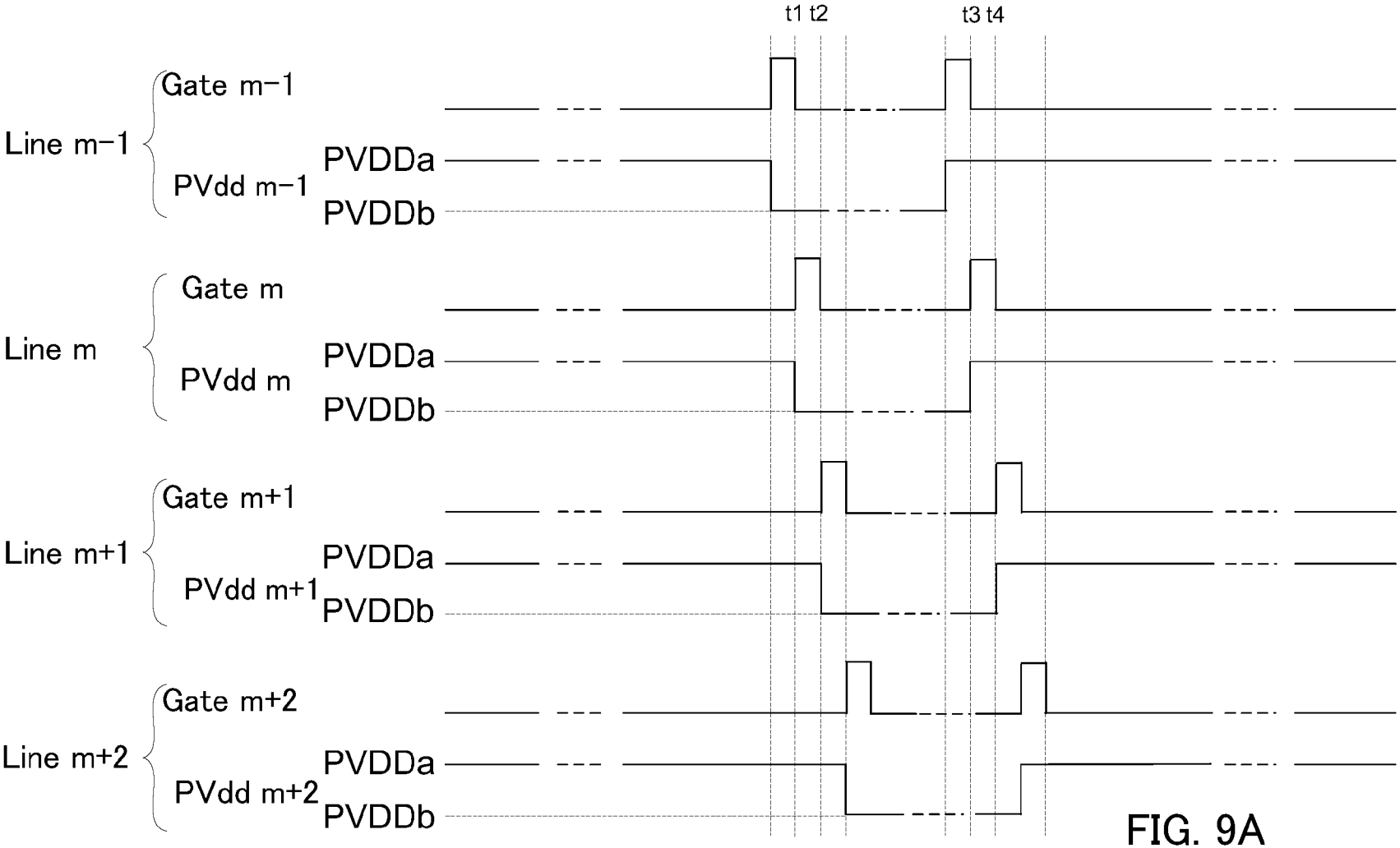
FIG. 9A is a drawing showing timing for changing voltage of gate lines and horizontal PVDD lines.
Figure 9B:
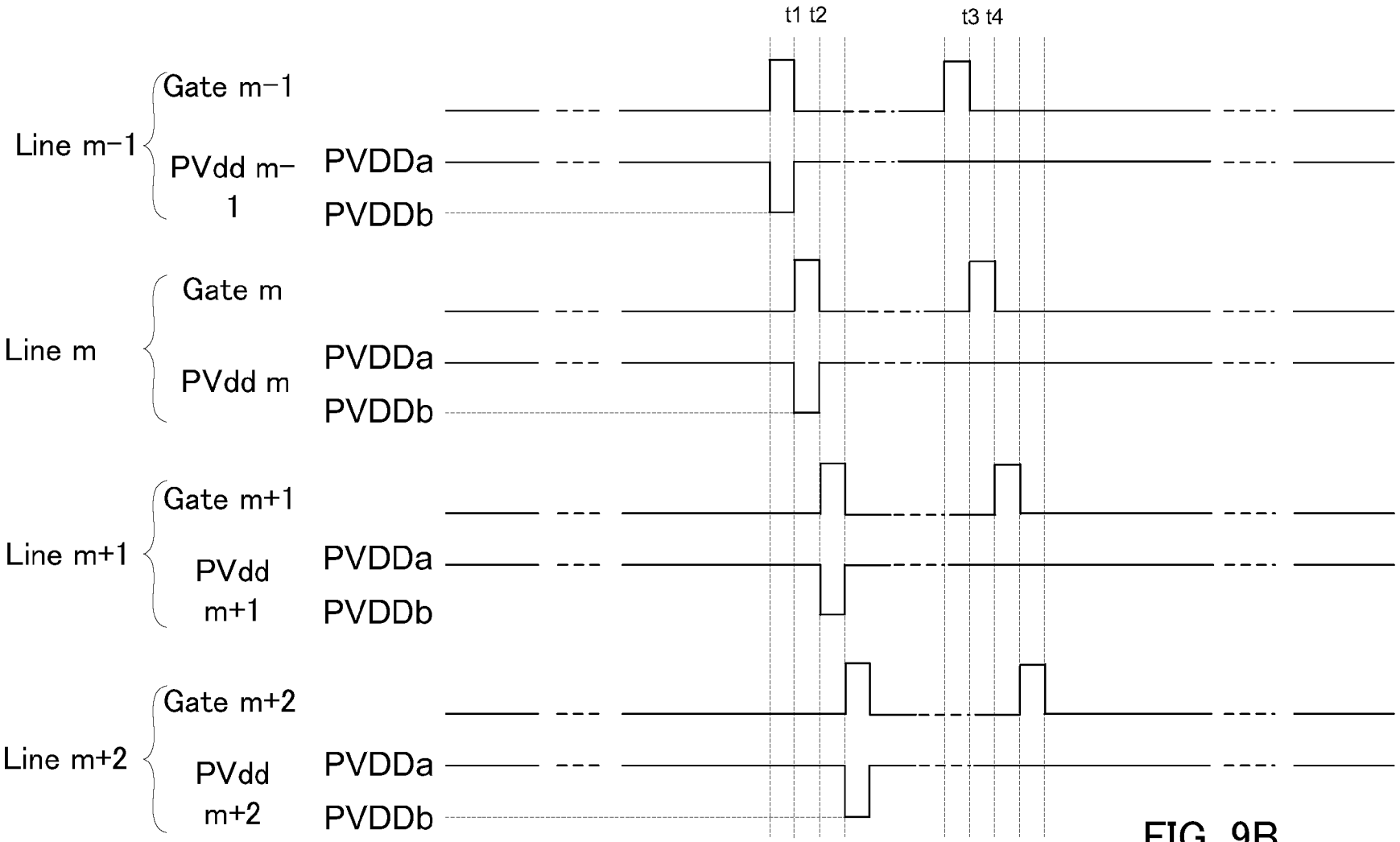
FIG. 9B is a drawing showing timing for changing voltage of gate lines and horizontal PVDD lines.

Timing for changing voltage of gate lines Gate and horizontal PVDD lines 12 can be as shown in FIG. 9A or FIG. 9B. If line m is taken as an example, since a voltage that is higher than the source side terminal is written to the gate side of the storage capacitor in the period from t1 to t2, a reverse bias voltage is applied to the pixels of line m to turn them off until the gate line is made high level again, that is, during the period from t1 to t3. In FIG. 9A the voltage of the horizontal PVDD line 12 is maintained at PVDDb in the period from t1 to t3, but in FIG. 9B the voltage of the horizontal PVDD line 12 is maintained at PVDDb only for the period t1 to t2, and from t2 the voltage of the horizontal PVDD line 12 returns to PVDDa.

OTHER EXAMPLES

Figure 1:
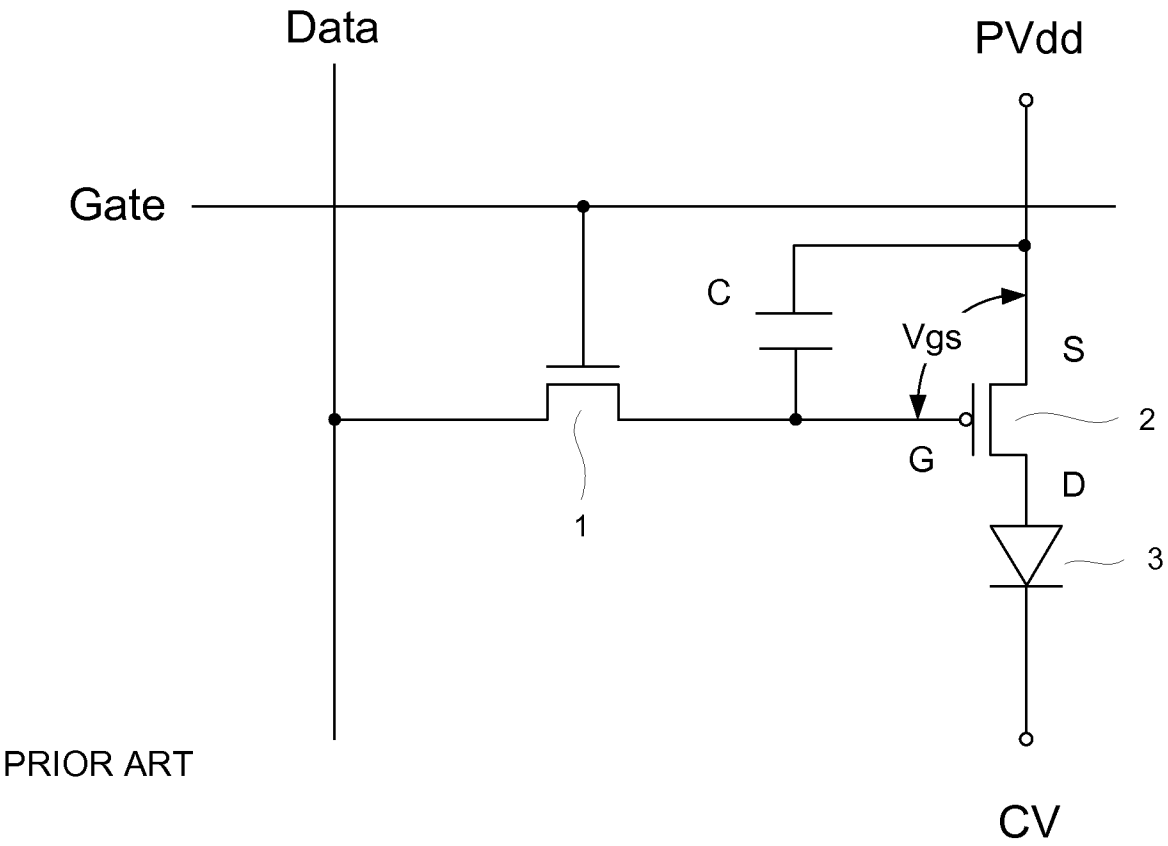
FIG. 1 is a drawing showing the structure of a pixel circuit.
Figure 10:
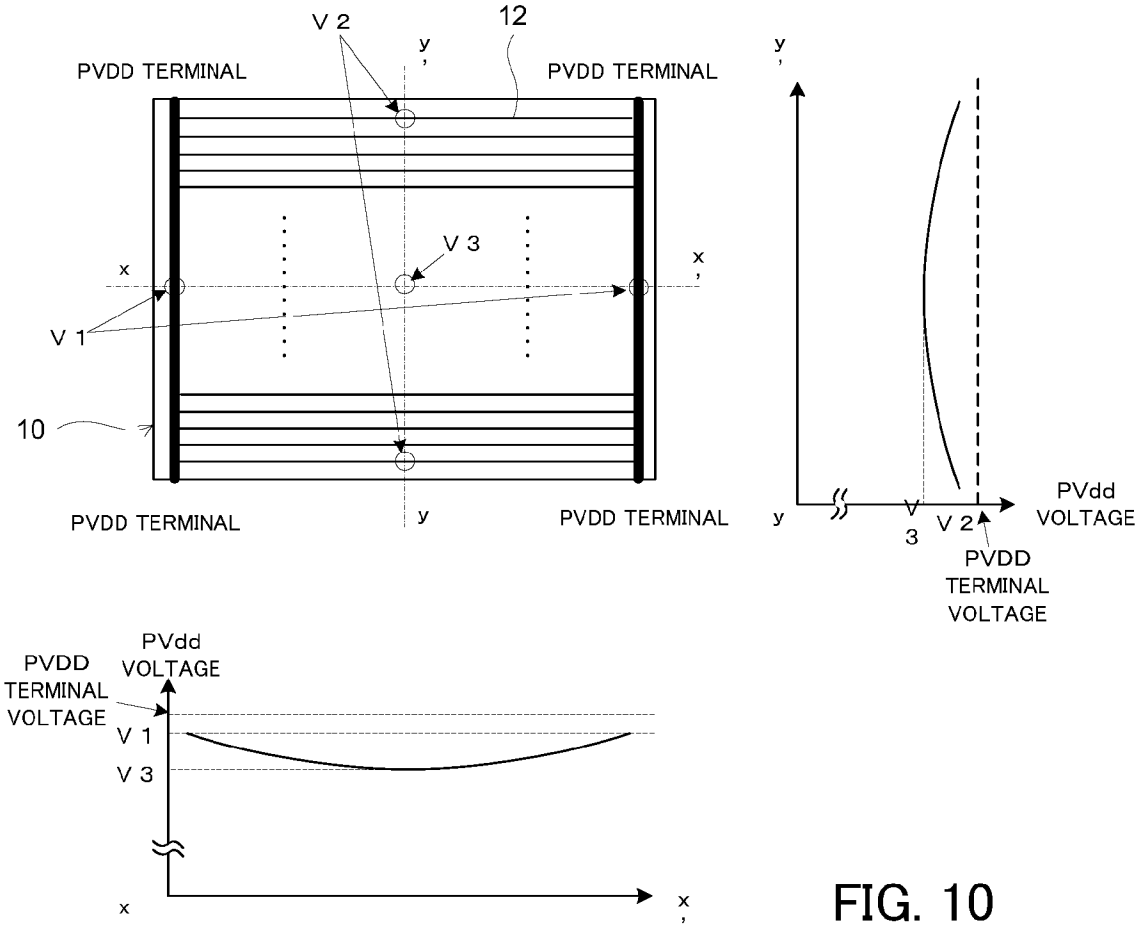
FIG. 10 is a drawing showing the appearance of voltage lowering in the case of lighting up an entire panel.

1) In the pixel circuit of FIG. 1 resistive components accompanying wiring are not depicted, but since a plurality of pixels are connected to a horizontal PVDD line 12, if there is resistance components there will be variation in the voltage of the source of the drive TFT for driving the organic EL element dependent on the magnitude of the current of other pixels. That is, as current of pixels that are connected to the horizontal PVDD line 12 and the vertical PVDD line 14 increases, lowering of voltage will increase. FIG. 10 is a drawing showing the appearance of voltage lowering in the case where a panel provided with horizontal PVDD lines provided in a horizontal direction parallel to the pixels is completely lit up. If power supply voltage PVDDa is supplied from both upper and lower ends of two vertical PVDD lines 14*a* provided at both sides of the organic EL panel 10 in this way, and a horizontal PVDD line 12 for each line is connected between the two vertical PVDD lines 14*a*, then voltage lowering of central portions will be reduced in the vertical direction and the horizontal direction. In the description of this voltage lowering, the fact that there are two types of vertical PVDD line is not relevant, and so FIG. 10 shows only one vertical PVDD line, and describes that the horizontal PVDD lines 12 are connected to that single vertical PVDD line. Supply of current to the pixels for emitting light is actually via the vertical PVDD lines 14*a*, and it can also be considered to represent a state where the vertical PVDD lines 14*a* are selected by the switches.

Figure 11:
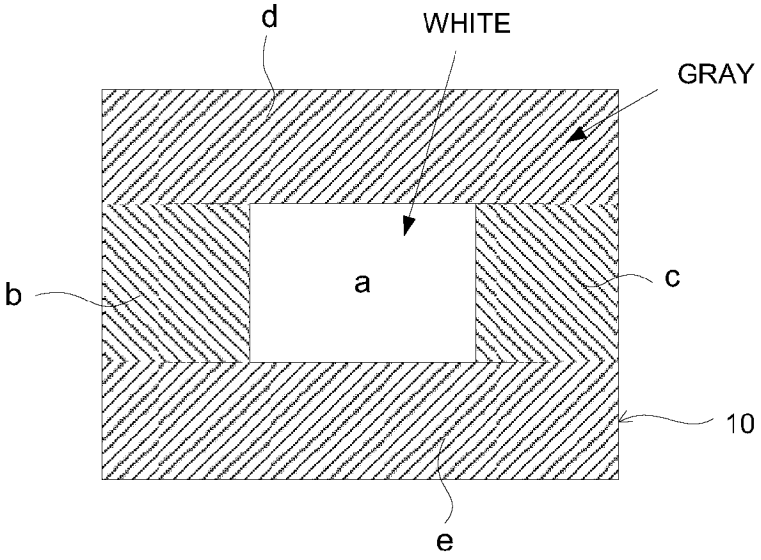
FIG. 11 is a drawing showing the appearance when a white window is displayed on a grey background, in a panel having power supply lines arranged as shown in FIG. 10.

If the selection TFT 1 is turned ON and there is a lowering of the source voltage during writing of a Data voltage to the storage capacitor C, an absolute value of Vgs will drop, which means that pixel current is reduced and emission brightness is lowered. For example, with a panel having power supply lines arranged as shown in FIG. 10, in the case where a white window pattern is displayed on a grey background, as shown in FIG. 11, as the left and right (sections b and c) of the window approach the window they become darker than other background sections (sections d and e), and its boundaries with other sections are noticeable.

Accordingly, design is carried out to reduce the resistance of PVDD lines by increasing the width of lines (vertical and horizontal PVDD lines) that supply a power supply (PVdd) voltage, and laying them out in a crisscross mesh shape etc. to an extent that does not impair the pixel aperture ratio. However, with this embodiment, in a region where the pixels are arranged, it is necessary to layout the horizontal PVDD lines in only a horizontal scanning direction, and voltage lowering also arises due to the on resistance of the inserted switches SW. With a large size panel in which PVDD lines are long and pixel current is high, brightness inconsistencies that are caused by the voltage lowering due to the resistance of these long lines can not be ignored. In order to solve this problem, it is preferable to have a structure as in the following embodiment. In this manner, in addition to the effects of this embodiment, it is also possible to improve brightness inconsistencies arising due to resistive portions of the PVDD lines.

Figure 12:
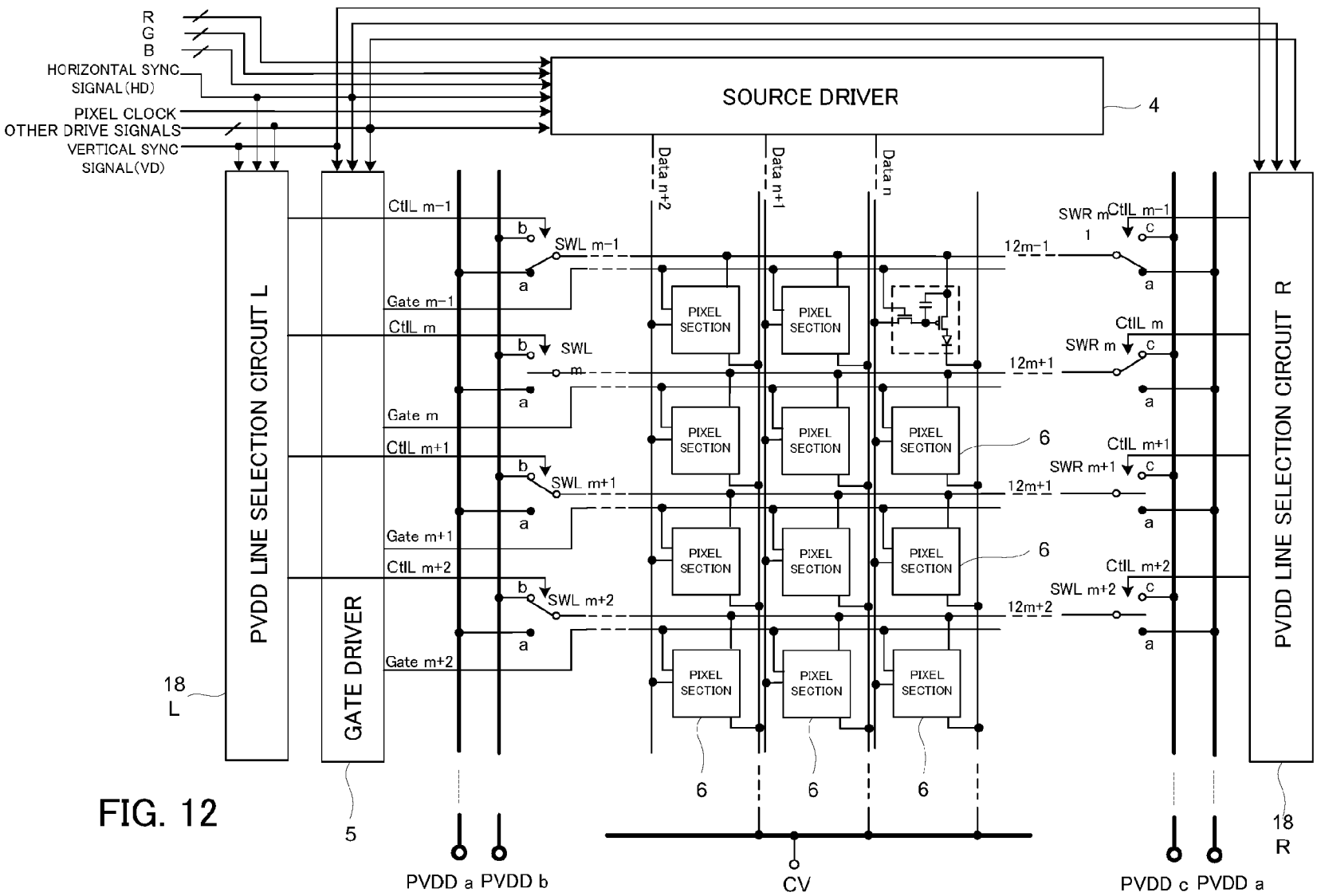
FIG. 12 is a drawing showing an arrangement of 4 lines by three rows of pixels in the case where a switch SW is provided on both sides of every horizontal PVDD line.
Figure 13:
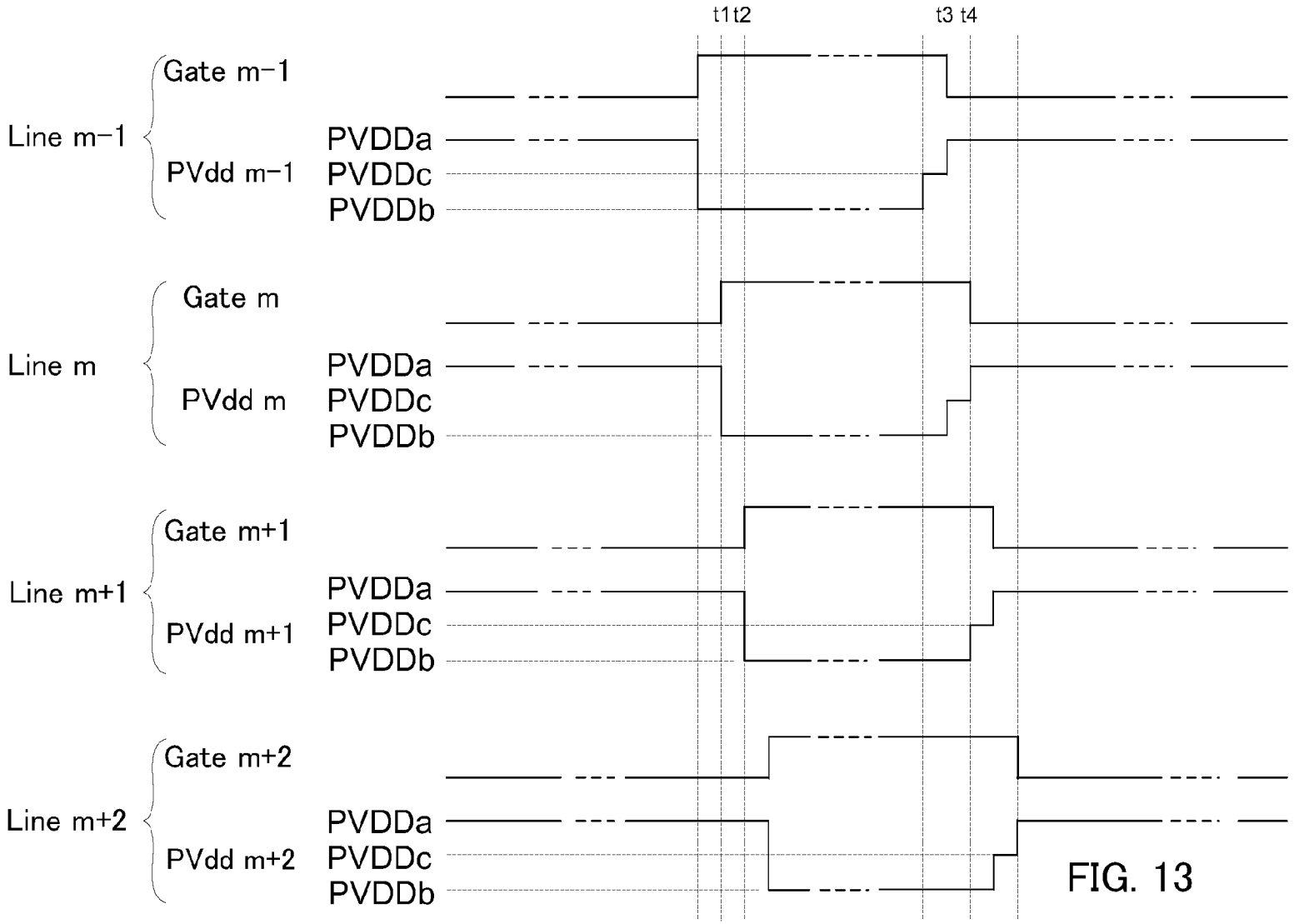
FIG. 13 is a drawing showing timing for changing voltage of horizontal PVDD lines and each gate line in the case of FIG. 12.

FIG. 12 is a drawing showing an arrangement of 4 lines by three rows of pixels in the case where a switch SW is provided on both sides of every horizontal PVDD line 12. The left side switches SWL are for alleviating afterimage by applying reverse bias to the drive TFTs that have been described thus far. The right side switches SWR are for reducing brightness inconsistencies due to resistance of the PVDD lines. FIG. 13 shows timing of changing PVDD voltage and gate line voltage for line m−1 to line m+2.

If line m is considered, then in FIG. 13 at the time of light emission of the pixels after t1 and before t4 the switches SWLm and SWRm are both turned to the a side so as to supply power from PVDDa to the horizontal PVDD line 12. At time t1, since a reverse bias is applied to the drive TFT for the pixels of that line, SWLm is turned to the b side, and SWRm is open. At this time, the gate line of line m becomes high level, and the selection TFT 1 is turned on. In the period from t3 to t4, data will be written to the storage capacitor of the pixels of line m, but with the voltage of the horizontal PVDD line 12*m* of line m still at PVDDb data is not written and so simultaneously with SWLm becoming open SWRm is turned to the c side and PVDDc is supplied to the horizontal PVDD line 12*m*. Here, PVDDc is a voltage set so that an appropriate pixel current flows for a data voltage supplied from the source driver 4. Specifically, in this example PVDDc is set to a voltage which is a sufficiently high voltage compared to the data voltage so that a voltage difference between the data voltage and the power supply voltage can be written to the storage capacitor C as a data voltage. Each of the switches in FIG. 12 are shown in the state of period t3 to t4.

Since image data is written sequentially for every line from the top, then while the gate line Gate for a particular line is turned on until writing is completed, the SWL of that line is open, and SWRc is turned to the c side. Accordingly, even if current flowing in the horizontal PVDD line 12*m* that flows from the vertical PVDD lines 14*c* is maximum, this is the sum current of pixels for one line and is extremely small at (1/the number of lines) times the pixel current for a single screen, and it is a simple matter to design vertical PVDD lines to have a resistance component such that voltage lowering from the power supply terminals (PVDDc terminals) to the switches can be ignored. Specifically, voltage lowering of the horizontal PVDD line 12*m* can be ignored even if a thin vertical PVDD line 14*c* is used. It is also possible to write an accurate data voltage to pixels if voltage lowering due to resistance of the horizontal PVDD line 12*m* can also be disregarded.

If writing to this mth horizontal line is completed, switches SWL and SWR are changed over and SWL and SWR are both connected to PVDDa. After that the selection TFT is off, and so even if there is a change in the power supply voltage of the pixel (PVdd voltage) the terminal voltage of the storage capacitor, namely Vgs, does not change which means that as long as an accurate Data voltage has been written to the storage capacitor C it is possible for the same pixel current to flow and to cause light emission at the same brightness even if there is a some degree of change in the PVdd voltage.

Figure 14:
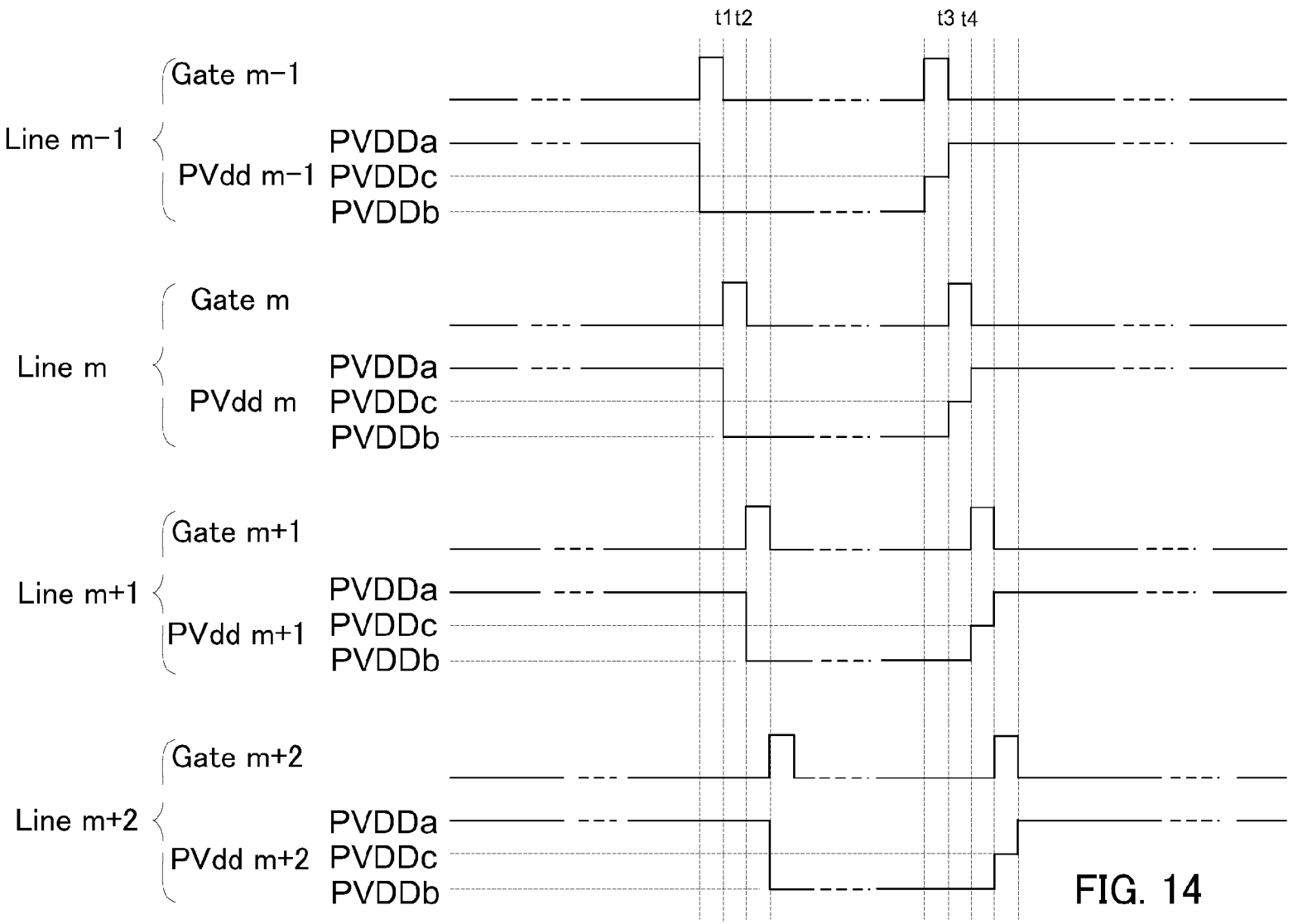
FIG. 14 is a drawing showing an example of turning a selection TFT on by making the voltage of a gate line Gate low level only in a desired period.

The timing chart of FIG. 14 shows an example of turning a selection TFT1 on by making the voltage of a gate line Gate low level only in a desired period. Specifically, for line m, the selection TFT1 is turned on only in the period t1 to 2, and turned off in the period from t2 to t3.

In any event, since in general the horizontal PVDD lines 12 have a comparatively high resistance the PVdd voltage is lowered due to the pixel current for one horizontal line. If there is voltage lowering of PVdd at the time of pixel data writing, a voltage that is lower than the desired voltage will be written to both terminals of the storage capacitor C across the gate and source of the drive TFT2, and current flowing in the organic EL element 3 will be reduced. It is therefore preferable to reduce the pixel current for that horizontal line as much as possible at the time of data voltage write.

Figure 15B:
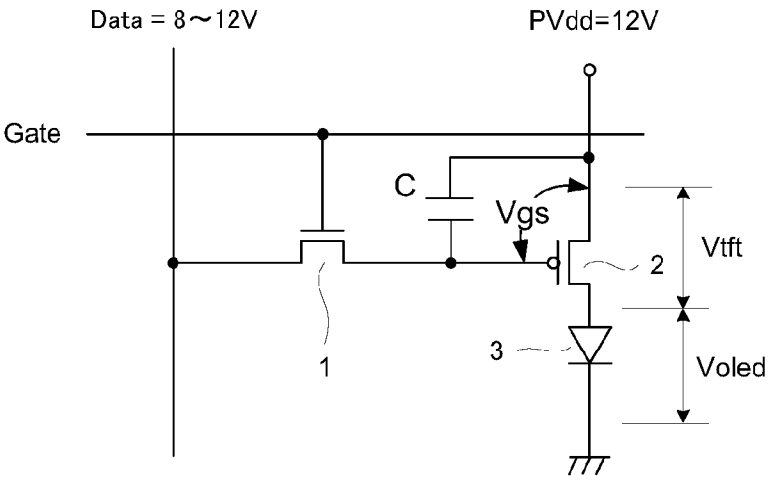
FIG. 15B is a drawing showing an example of how to apply power supply and data voltage in the case of FIG. 15A.
Figure 15A:
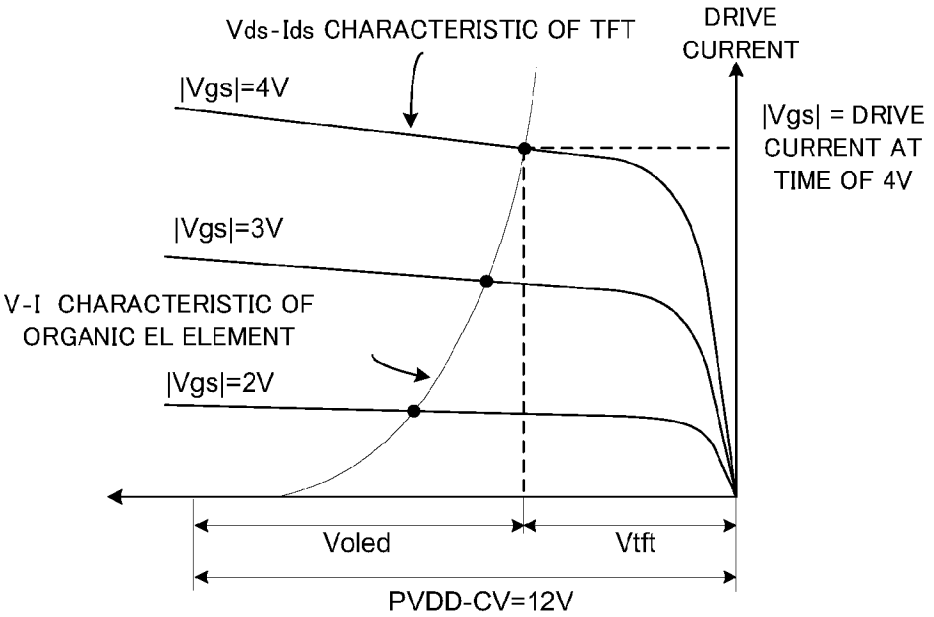
FIG. 15A is a drawing showing operating points of a pixel circuit in the case where (PVdd-CV) is made 12V.
Figure 16:
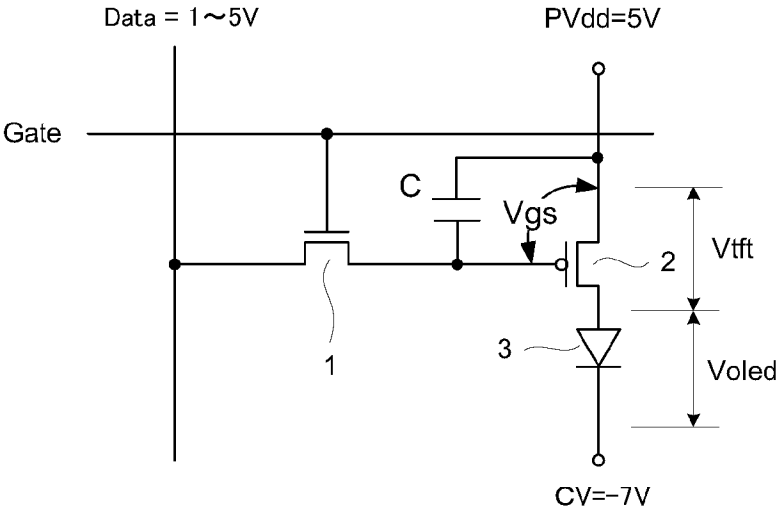
FIG. 16 is a drawing showing an example of how to apply power supply and data voltage when a negative voltage (−7V) is used in CV.

Normally, a voltage (Pvdd-CV) between PVVD (PVDDa) and CV is determined using characteristic of the drive TFT2 and organic EL element 3, and maximum amplitude value of the input data voltage (Vp-p). FIG. 15A shows operating points of a pixel circuit in the case where (PVdd-CV) is made 12V. Current of operating points on a characteristic of current flowing from drain to source with respect to a voltage across the drain and source when a particular VGS is applied to the drive TFT (Vds-Ids characteristic), and on a V-I characteristic of the organic EL element, flows in the drive TFT and the organic EL element. With this example, when Vgs=4V, a maximum current corresponding to a white level flows. FIG. 15B is one example of how to apply the power supply and Data voltage in this case, but it is necessary to make the output voltage of the source drain region a high voltage. In order to avoid this, a negative power supply (−7V) is normally used in CV, as shown in FIG. 16. In this case it is possible to drive the source driver IC with a low voltage because 1 to 5V can be applied as the Data voltage.

Figure 17B:
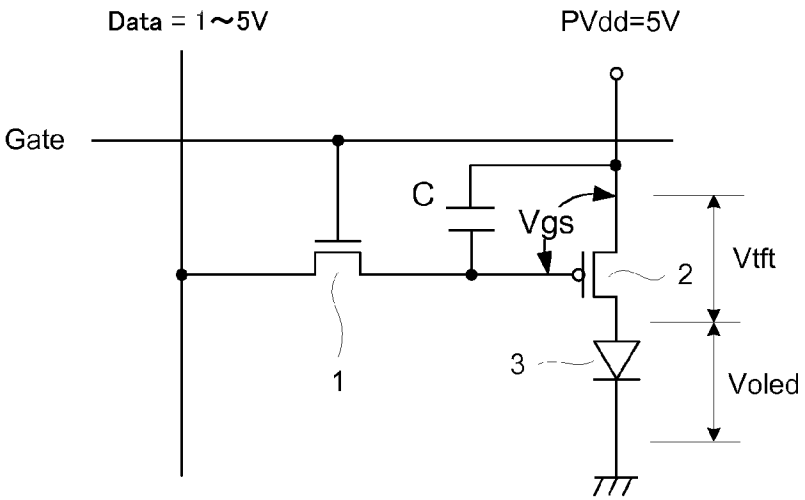
FIG. 17B is a drawing showing an example of how to apply power supply and data voltage in the case of FIG. 17A.
Figure 17A:
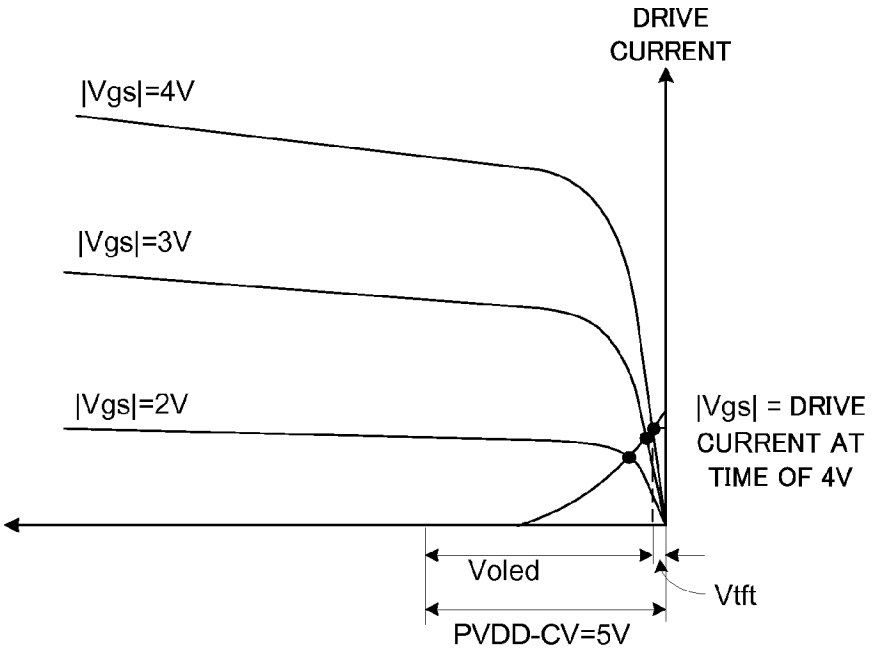
FIG. 17A is a drawing showing operating points of when (PVdd-CV) is made 5V.

If the voltage across PVDD and CV is made low, the pixel drive TFT is taken out of the saturation region and pixel current is reduced. FIG. 17A shows operating points when (PVdd-CV) is made 5V. By making the PVDD (for example PVDDc) voltage at the time of writing, that is the voltage of PVDDc, sufficiently lower than the voltage PVDDa at normal times, in this way, it is possible to lower the pixel current and suppress lowering of the PVdd voltage at the time of writing. By doing this it is also possible, as shown in FIG. 17B, to make the source driver IC low voltage without using a negative power supply in CV. At the time of data write, brightness of pixels of that line is lowered, but when writing is completed and the PVdd voltage becomes PVDDa a fixed brightness is achieved. With this example, it is possible to alleviate after-image if PVDDb is made 1V, which is the minimum value for data voltage, or less, but in order to obtain a greater effect it is possible to set lower, for example −5V.

Similarly to the initial example, it is possible for the timing of the gate lines to be as in FIG. 14.

Figure 18:
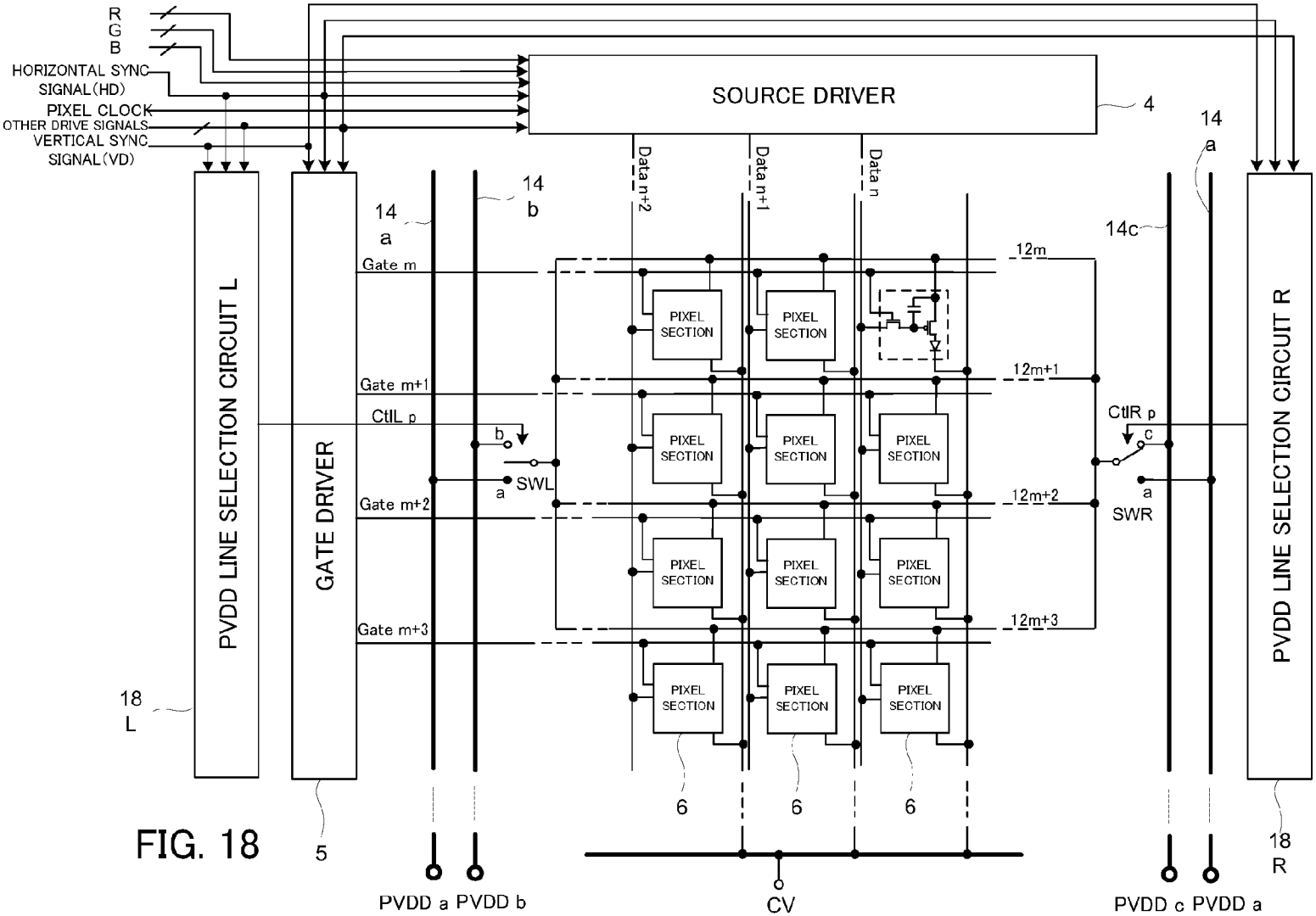
FIG. 18 is a drawing showing a structural example of a panel in the case where a switch SW is provided for every four horizontal PVDD lines.

2) FIG. 18 is a modification to the example described in 1) above, and is a structural example in the case where a switch SW is provided for every four horizontal PVDD lines 12. By grouping a plurality of horizontal PVDD lines 12 in this way and switching the power supply PVDDa and PVDDb to be supplied to them, it is possible to reduce the number of switches SW, which can in turn be expected to reduce defects. With this example, four horizontal PVDD lines 12*m* to 12*m*+3 for lines m to m+3 are made into a group, and connected to PVDD line selection circuits 18L and 18R by two switches SWL and SWR.

Figure 19:
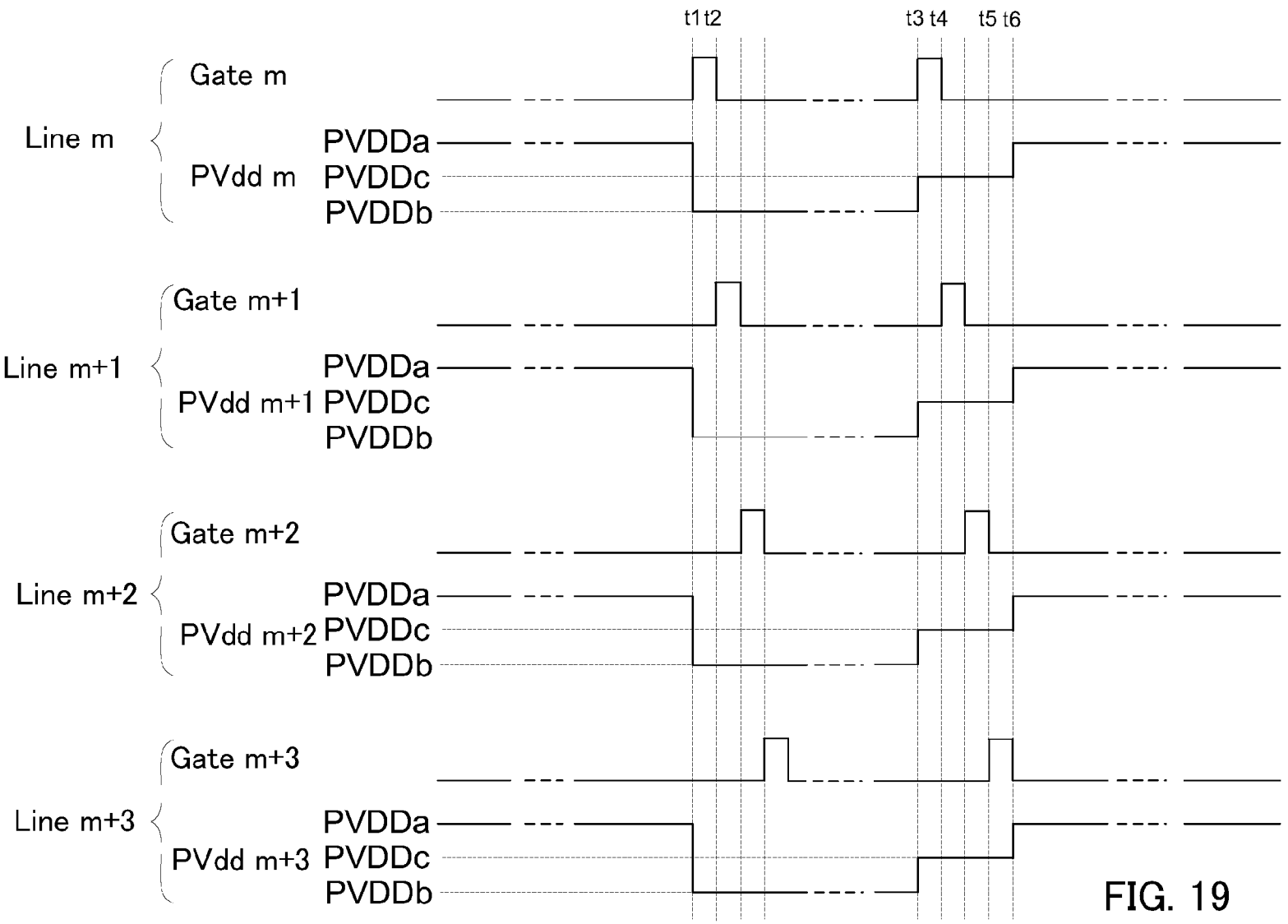
FIG. 19 is a drawing showing timing for changing voltage of horizontal PVDD lines and each gate line in the case of FIG. 18.

FIG. 19 shows timing for changing voltage of each horizontal PVDD line 12*m* and changing voltage of each gate line Gatem. In this case, it is necessary to turn off selection TFTs 1 for horizontal lines other than those in a group to which a horizontal line to be written to belongs, which means that it is possible to make the gate line Gate a continuously high level until a write period, as in the case where a switch is provided for every horizontal PVDD line 12. The gate lines of lines m to m+3 that have been grouped together are therefore set to high level at different times.

Figure 20:
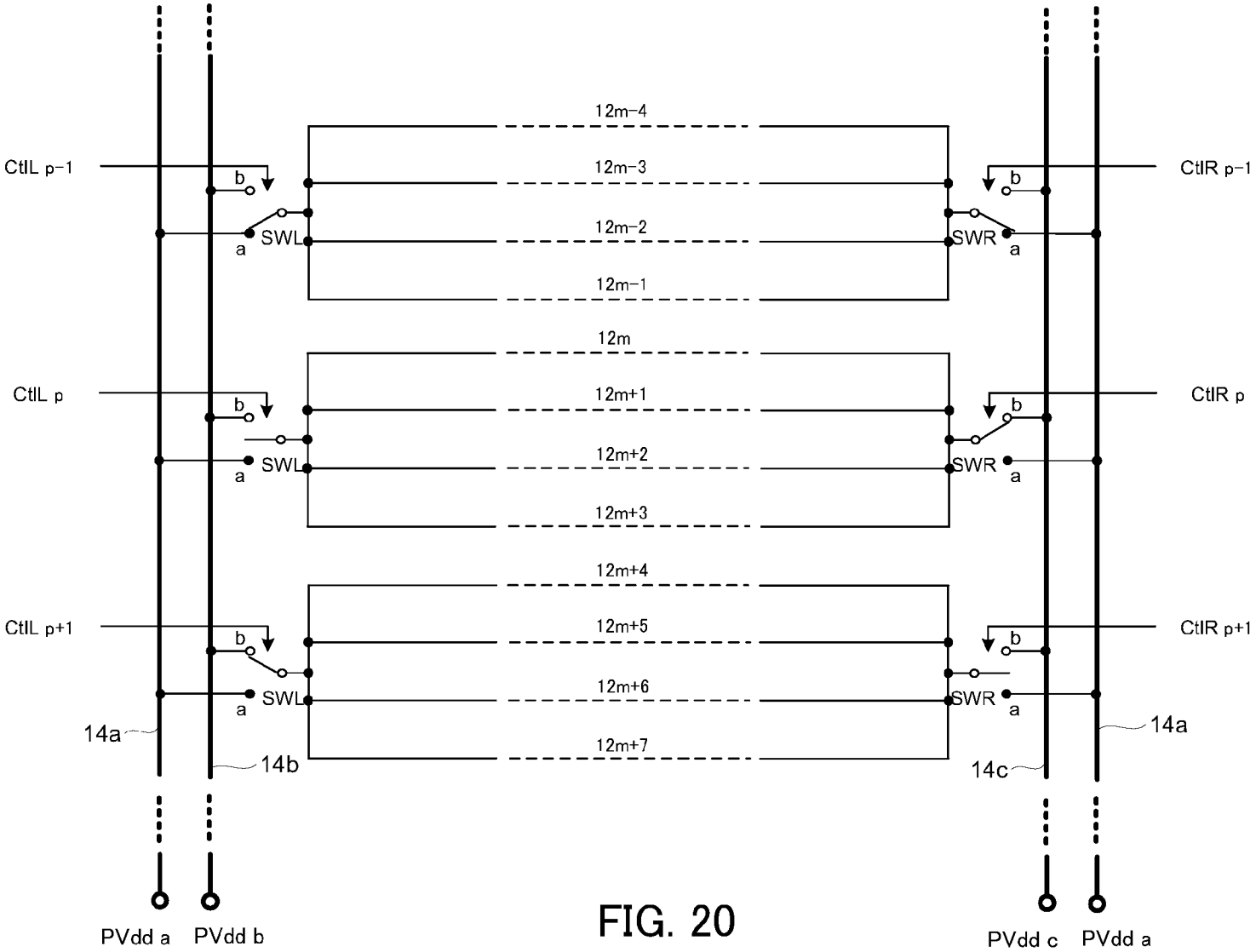
FIG. 20 is a drawing showing the state of switches connected to PVDDm−4 to PVDDm+7, in the period t1-t2 in FIG. 19.
Figure 21:
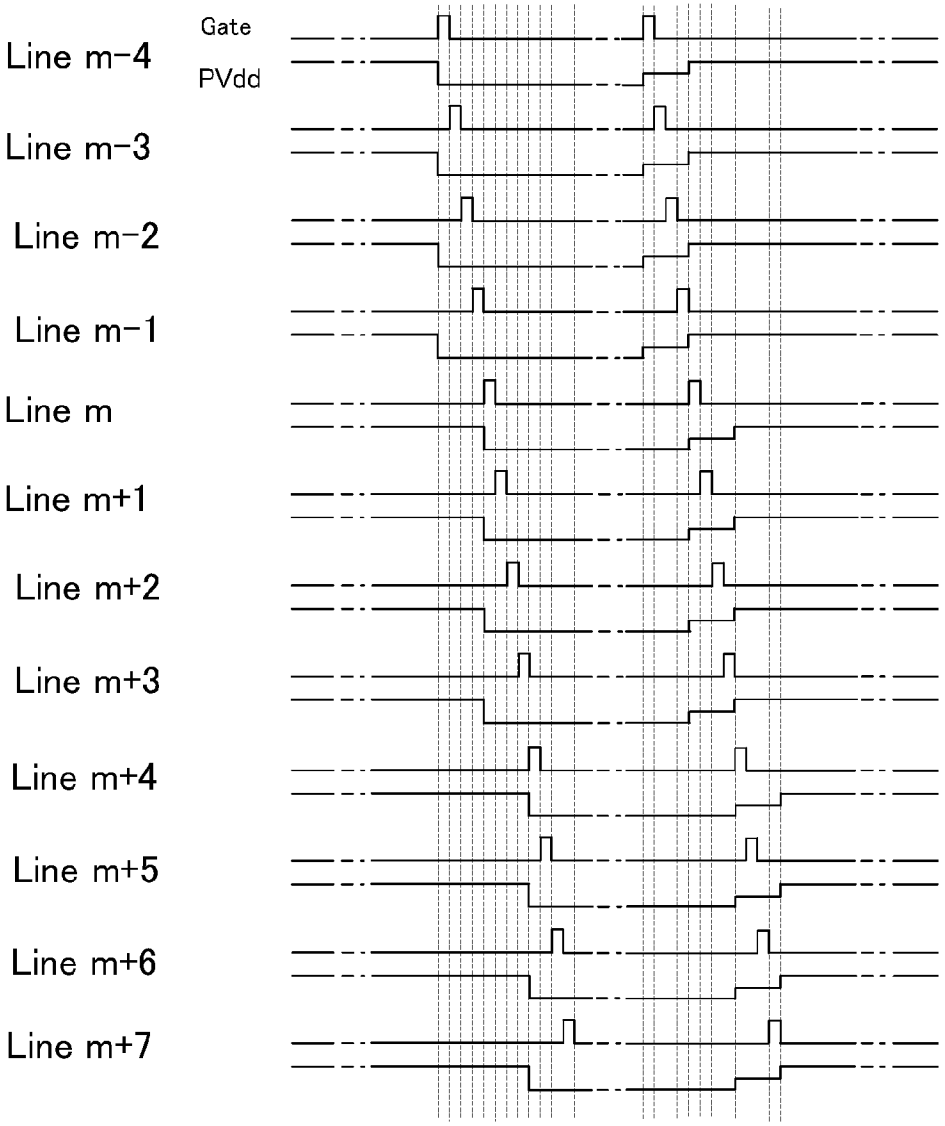
FIG. 21 is a drawing showing timing for changing voltage of horizontal PVDD lines and gate lines for line m−4 to line m+7.
Figure 22:
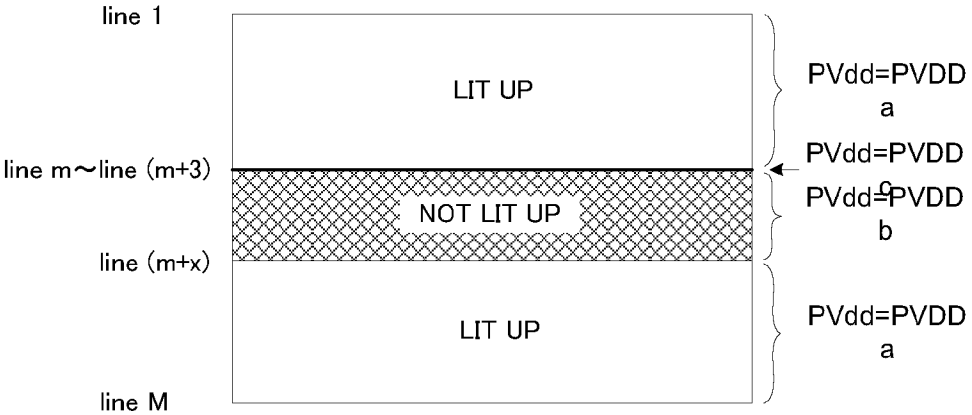
FIG. 22 is a drawing showing a lit up state of a screen in a period t3-t6 in FIG. 19.

FIG. 20 shows the state of switches connected to PVDDm−4 to PVDDm+7, in the period t1-t2. Also, FIG. 21 shows timing for changing voltage of horizontal PVDD lines and gate lines for line m−4 to line m+7, and FIG. 11 shows operating points of a screen in the period from t3 to t6.

In this way, the voltage of the horizontal PVDD line 12 is sequentially changed for every group (four lines), but the gate lines are sequentially set to high level and not set to high level at the same time.

In this case also, current flowing from the power supply PVDDc is a maximum of the total current flowing in pixels of four lines, and so is extremely small at (4/No. of horizontal lines) times the pixel current of one screen. As described previously, if the voltage of PVDDc is sufficiently low that pixel current can not flow, the period from t3 to t6 in FIG. 19 is an unlit period. Specifically, all lines are turned off for t1-t6.

Figure 23:
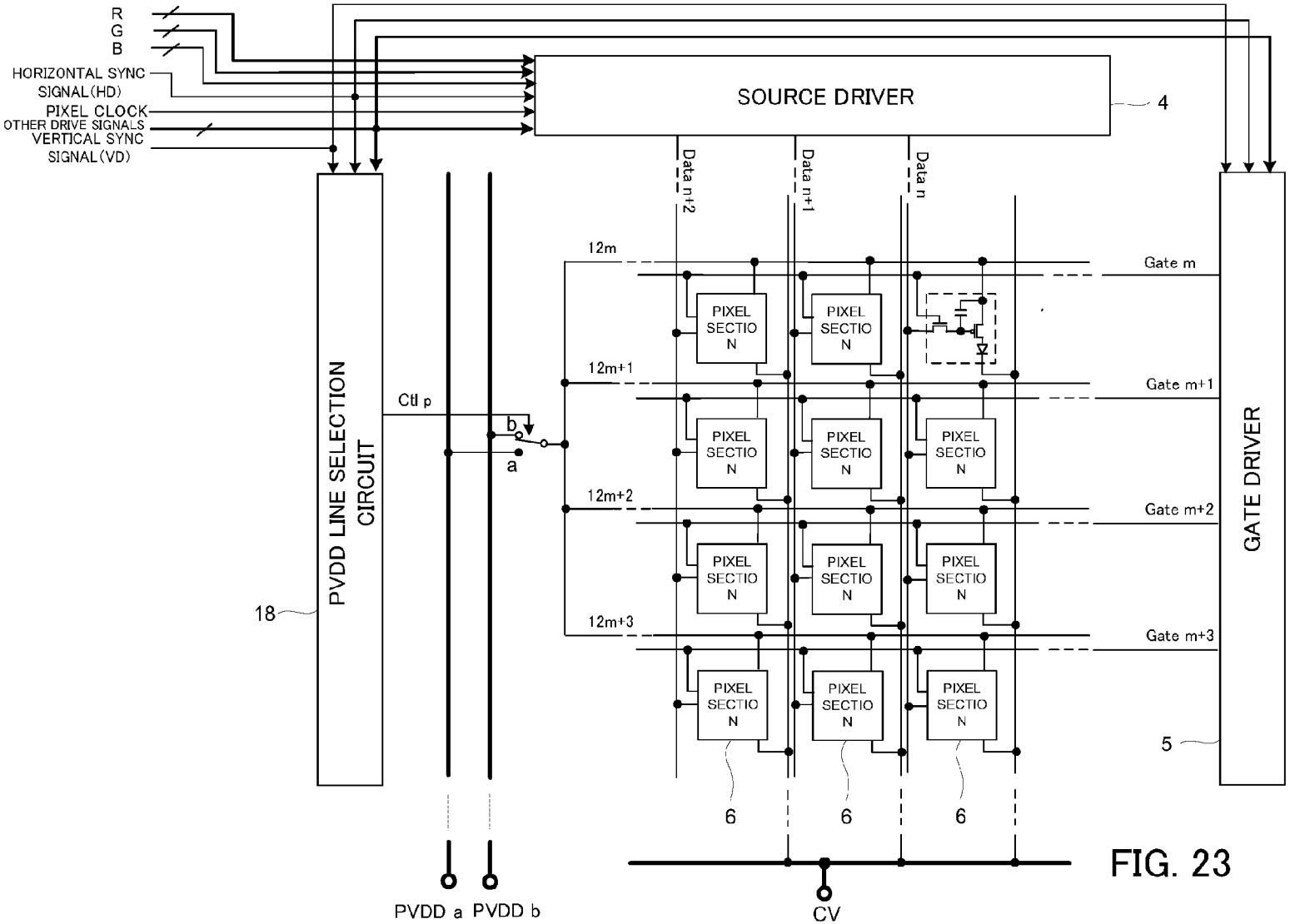
FIG. 23 is a drawing showing a structural example where horizontal PVDD lines are made into groups.
Figure 24:
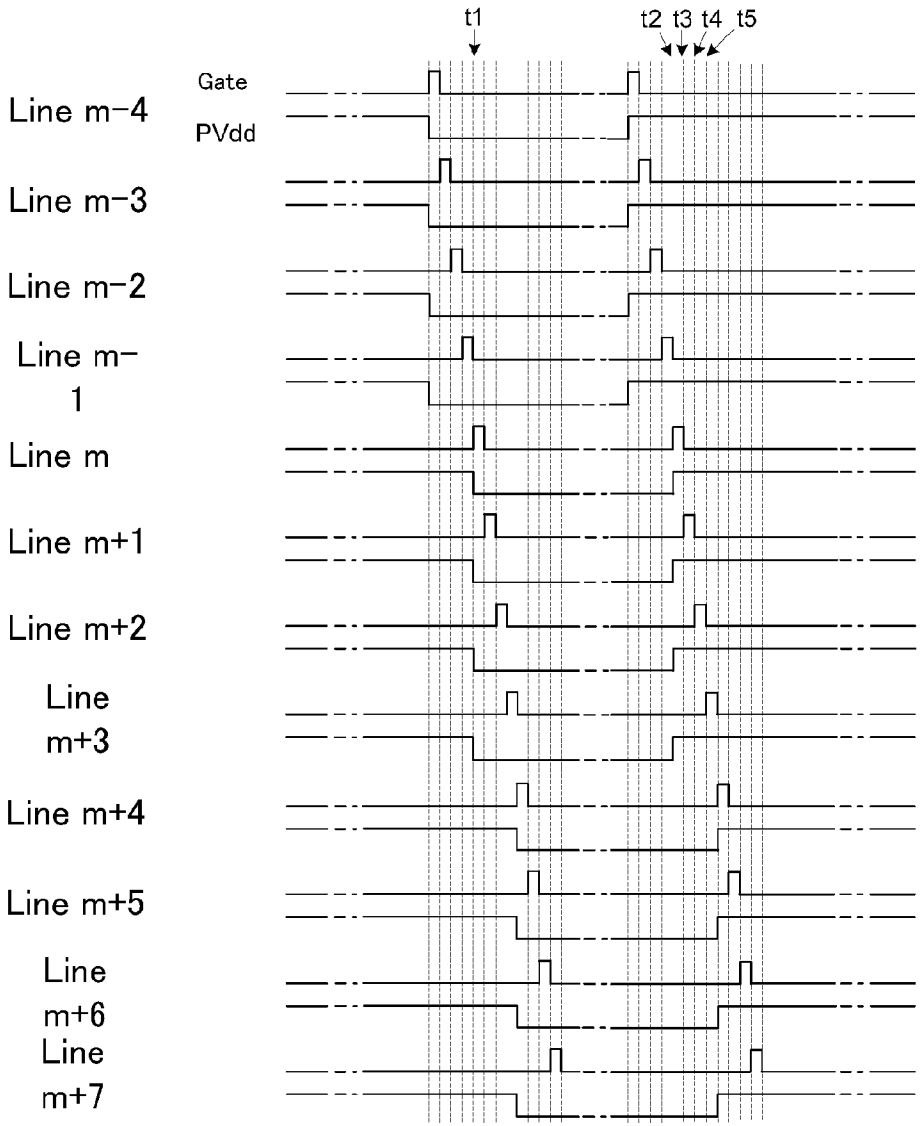
FIG. 24 is a drawing showing drive timing for the structural example of FIG. 23.

3) In the example of FIG. 6 it is also possible to form horizontal PVDD lines into groups, and a structural example and drive timing of such a case are respectively shown in FIG. 23 and FIG. 24.

Here, a turned off time for each line of a group consisting of from line m to line m+3 will be considered. In FIG. 24, line m has a turned off period from t1 to t2, line m+1 has a turned off period from t1 to t3, line m+2 has a turned off period from t1 to t4, and line m+3 has a turned off period from t1 to t5, and so within a group the turned off period slips for each line period. Average brightness of the display is (turned off time/1 frame period) times the brightness of the entire screen being lit up, and so a difference arises in the average brightness of each line. A brightness difference between a line having the highest average brightness and a line having the lowest average brightness becomes larger as a ratio of the number of lines in a group to the total number of horizontal lines of the panel becomes smaller. Accordingly when this ratio is made a value such that it is possible to detect a brightness difference for each line, there is a need for means to perform calculations on data input to the panel to cancel a brightness difference for each line within a group that occurs in the panel etc.

Figure 25:
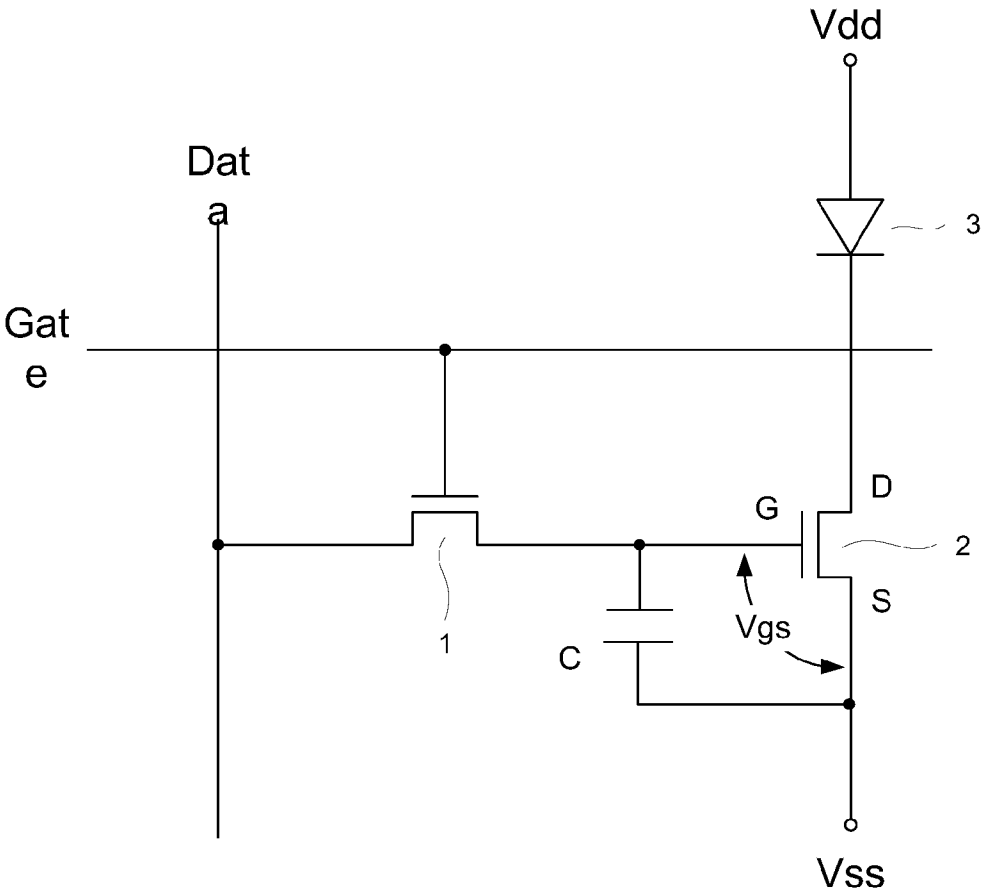
FIG. 25 is a drawing showing a structural example of a pixel circuit using N-channel type as the drive TFTs.

4) With the above example, description has been given for the case of using P-channel type in the drive TFTs. However, it is also possible to achieve similar effects with a similar structure in the case of a pixel circuit that uses N-channel type as the drive TFT, as shown in FIG. 25. An anode of the organic EL element 3 is connected to power supply VDD, while the cathode of the organic EL element 3 is connected to a drain of an N-channel type drive TFT 2. The source of the drive TFT is connected to power supply Vss. Also, a storage capacitor C is connected across the gate and source of the drive TFT 2, and a data line Data is connected to the gate of the drive TFT 2 via a selection TFT 1.

Here, In FIG. 25 Vdd corresponds to CV described previously, while Vss corresponds to PVdd. It is therefore preferable, in alleviating the afterimage phenomenon that is caused by a hysteresis characteristic of the drive TFT 2, for the source voltage, that is the voltage of the horizontal VDD line 20, to be higher than the gate voltage of the TFT2 to apply a reverse bias across the gate and source.

Figure 26:
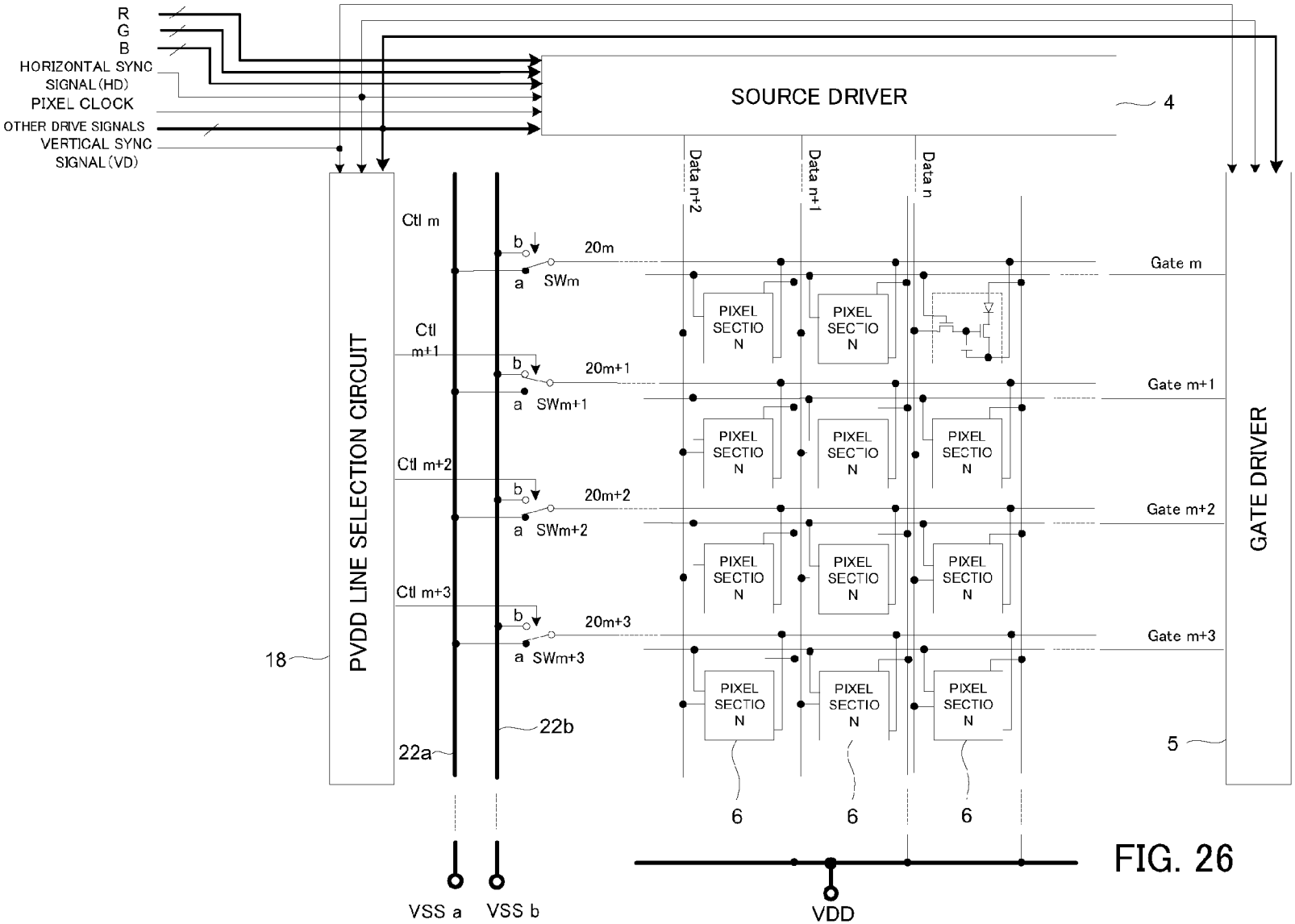
FIG. 26 is a drawing showing one example of the structure of a display panel, and input signals, in the case where the pixel circuit of FIG. 25 is adopted.
Figure 27:
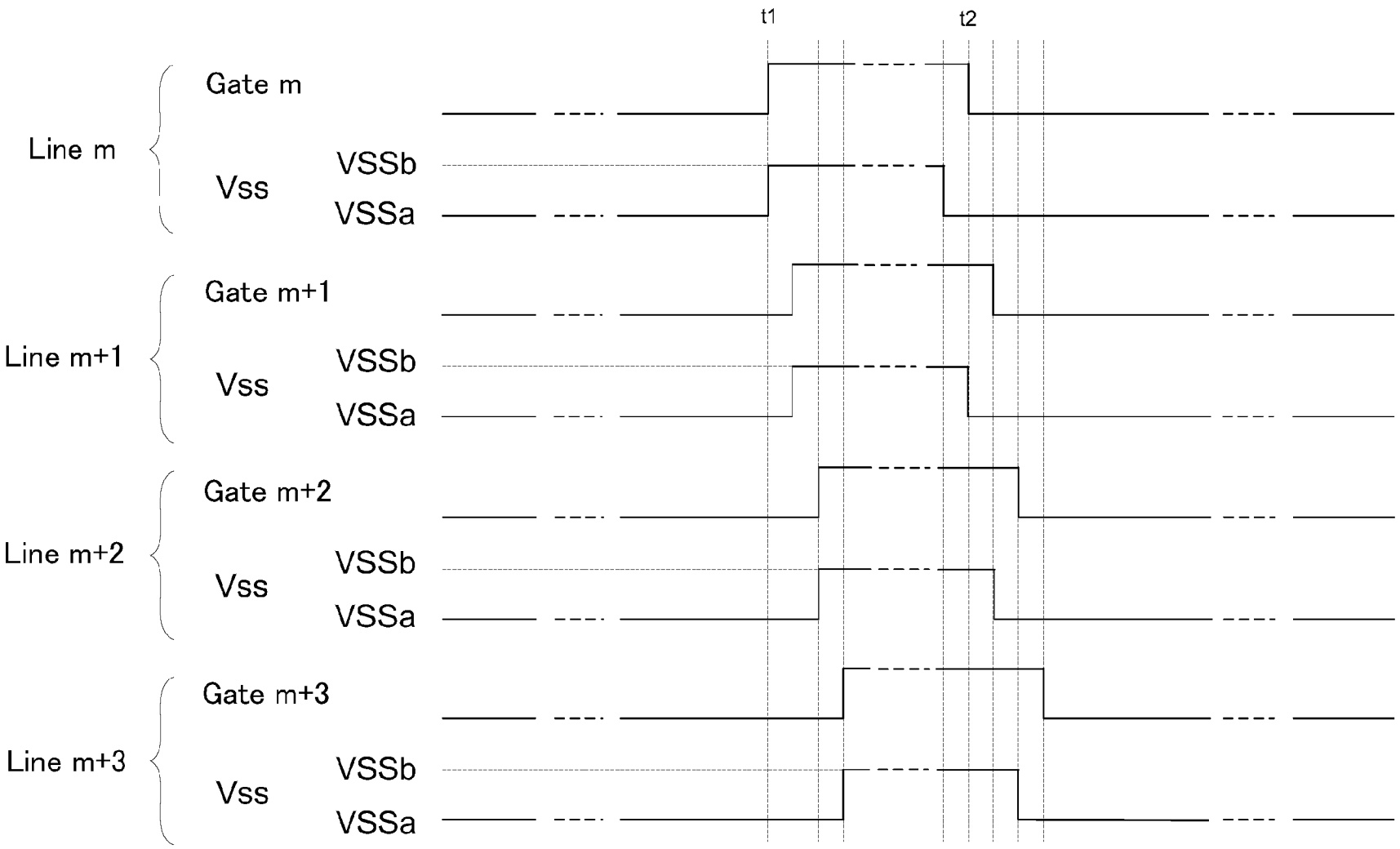
FIG. 27 is a drawing showing timing for changing Vss voltage and gate line voltage for line m to line m+3 of the panel of FIG. 26.

A configuration in the case where a switch is provided for every line of the power supply VSS, and and example of drive timing, are shown in FIG. 26 and FIG. 27 respectively. As shown in FIG. 26, a horizontal VSS line 20 is arranged on every line, and the horizontal VSS lines 20 are connected via the switch SW to vertical VSS lines 22*a* and 22*b*, and via those vertical VSS lines to power supplies VSSa and VSSb. VSSa is a normal power supply voltage, and VSSb is a voltage for applying a reverse voltage.

In the example of FIG. 25 to FIG. 27 also, it is possible to have the same modification as for the case of using a P-channel drive TFT described above.

What is claimed is:

1. An active matrix organic EL display device with pixel circuits arranged in a plurality of rows, each row comprising:

a plurality of pixel circuits, each pixel circuit comprising a selection TFT, a drive TFT, a storage capacitor, and an organic EL light emitting element;

a horizontal power line connected to a power terminal of each of the plurality of pixel circuits;

a first switch having a first common terminal connected to a first end of the horizontal power line, a first terminal connected to a first power supply, and a second terminal connected to a second power supply, wherein the first switch controllably connects the first end of the horizontal power line to either the first power supply, the second power supply, or to an open circuit;

a second switch, having a second common terminal connected to a second end of the horizontal power line, a third terminal connected to the first power supply, and a fourth terminal connected to a third power supply, wherein the second switch controllably connects the second end of the horizontal power line to either the first power supply, the third power supply, or to an open circuit; and wherein, during a first time period, the first switch and the second switch are controlled to apply the first power supply to the first and second ends of the horizontal power line and the plurality of pixel circuits emit light, and, during a second time period, the first switch is controlled to apply the second power supply to the first end of the horizontal power line and the second switch is controlled to apply an open circuit to the second end of the horizontal power line and wherein the second power supply is set to a voltage such that the drive TFT in each of the plurality of pixel circuits is reverse biased.

2. The active matrix organic EL display device of claim 1, each row additionally comprising:

a gate line connected to a gate of the selection TFT of each of the plurality of pixel circuits.

3. An active matrix organic EL display device with pixel circuits arranged in a plurality of groups of rows, with four rows in each group, each group of four rows comprising:

a plurality of pixel circuits, each pixel circuit comprising a selection TFT, a drive TFT, a storage capacitor, and an organic EL light emitting element;

four horizontal power lines, each horizontal power line associated with one row within the group of four rows and connected to a power terminal of each of the plurality of pixel circuits in the associated row;

a first switch having a first common terminal connected to a first end of the four horizontal power lines, a first terminal connected to a first power supply, and a second terminal connected to a second power supply, wherein the first switch controllably connects the first end of the four horizontal power lines to either the first power supply, the second power supply, or to an open circuit;

a second switch, having a second common terminal connected to a second end of the four horizontal power lines, a third terminal connected to the first power supply, and a fourth terminal connected to a third power supply, wherein the second switch controllably connects the second end of the four horizontal power lines to either the first power supply, the third power supply, or to an open circuit; and wherein, during a first time period, the first switch and the second switch are controlled to apply the first power supply to the first and second ends of the four horizontal power lines and the plurality of pixel circuits emit light, and, during a second time period, the first switch is controlled to apply the second power supply to the first end of the four horizontal power lines and the second switch is controlled to apply an open circuit to the second end of the four horizontal power lines and wherein the second power supply is set to a voltage such that the drive TFT in each of the plurality of pixel circuits is reverse biased.

* * * * *